US010900166B2

(12) United States Patent
Schimper et al.

(10) Patent No.: US 10,900,166 B2
(45) Date of Patent: Jan. 26, 2021

(54) TREATMENT OF TEXTILE MATERIAL

(71) Applicant: ACTICELL GMBH, Vienna (AT)

(72) Inventors: Christian Bruno Schimper, Vienna (AT); Paul Pachschwöll, Krems (AT); Hubert Hettegger, Tulln an der Donau (AT)

(73) Assignee: ACTICELL GMBH, Vienna (AT)

( * ) Notice: Subject to any disclaimer, the term of this patent is extended or adjusted under 35 U.S.C. 154(b) by 0 days.

(21) Appl. No.: 16/004,276

(22) Filed: Jun. 8, 2018

(65) Prior Publication Data

US 2018/0291553 A1 Oct. 11, 2018

Related U.S. Application Data

(63) Continuation-in-part of application No. PCT/EP2016/080370, filed on Dec. 9, 2016, and a continuation-in-part of application No. PCT/EP2016/080371, filed on Dec. 9, 2016.

(30) Foreign Application Priority Data

| | | |
|---|---|---|
| Dec. 10, 2015 | (EP) | 15199312 |
| Dec. 10, 2015 | (EP) | 15199315 |
| Mar. 7, 2016 | (EP) | 16159019 |
| Mar. 7, 2016 | (EP) | 16159022 |

(51) Int. Cl.

| | |
|---|---|
| ***D06L 4/22*** | (2017.01) |
| ***D06L 4/00*** | (2017.01) |
| ***D06P 1/46*** | (2006.01) |
| ***D06P 5/15*** | (2006.01) |
| ***D06P 1/653*** | (2006.01) |
| ***D06P 1/673*** | (2006.01) |
| ***D06P 5/13*** | (2006.01) |
| ***D06B 11/00*** | (2006.01) |

(52) U.S. Cl.

CPC ..... *D06L 4/22* (2017.01); *D06L 4/00* (2017.01); *D06P 1/46* (2013.01); *D06P 1/653* (2013.01); *D06P 1/6533* (2013.01); *D06P 1/67341* (2013.01); *D06P 1/67366* (2013.01); *D06P 1/67375* (2013.01); *D06P 1/67391* (2013.01); *D06P 5/13* (2013.01); *D06P 5/132* (2013.01); *D06P 5/135* (2013.01); *D06P 5/15* (2013.01); *D06P 5/153* (2013.01); *D06P 5/156* (2013.01); *D06B 11/0096* (2013.01)

(58) Field of Classification Search

CPC ..... D06L 4/00; D06L 4/22; D06P 5/13; D06P 5/132; D06P 5/135; D06P 5/15; D06P 5/153; D06P 5/156; D06P 1/46; D06P 1/653; D06P 1/6533; D06P 1/67341; D06P 1/67366; D06P 1/67375; D06P 1/67391; D06B 11/0096

See application file for complete search history.

(56) References Cited

U.S. PATENT DOCUMENTS

| | | | | | |
|---|---|---|---|---|---|
| 4,997,450 | A * | 3/1991 | Olson | D06P 5/153 8/109 |
| 5,350,423 | A * | 9/1994 | Davis, Jr. | D06P 5/13 8/401 |
| 2005/0223507 | A1* | 10/2005 | Nakano | D06M 11/65 8/536 |
| 2016/0060807 | A1* | 3/2016 | Tharpe | B23K 26/70 264/400 |

FOREIGN PATENT DOCUMENTS

| | | | | |
|---|---|---|---|---|
| EP | 1486607 | A1 | 12/2004 | |
| JP | H11200261 | A | 7/1999 | |
| JP | 2004-068179 | * | 3/2004 | D06P 5/00 |
| JP | 2004068179 | A | 3/2004 | |

OTHER PUBLICATIONS

EP Application No. 16159019.5, extended European Search Report dated Jun. 6, 2016.
PCT International Application No. PCT/EP2016/080370, Int'l Preliminary Examination Report dated Jun. 12, 2018.
PCT International Application No. PCT/EP2016/080370, Int'l Search Report dated Mar. 21, 2017.
PCT International Application No. PCT/EP2016/080370, Int'l Written Opinion dated Mar. 21, 2017.

* cited by examiner

*Primary Examiner* — Amina S Khan
(74) *Attorney, Agent, or Firm* — Loza & Loza, LLP; Michael F. Fedrick

(57) ABSTRACT

The present invention generally relates to a method for changing the color of a textile material to obtain a vintage and/or worn appearance comprising the steps of contacting the fabric textile material with a nitrate salt, activating the nitrate salt by the addition of an acid catalyst until the desired color change is achieved.

7 Claims, No Drawings

TREATMENT OF TEXTILE MATERIAL

CROSS-REFERENCE TO RELATED APPLICATIONS

This application is a continuation-in-part of International Patent Application No. PCT/EP2016/080370, filed Dec. 9, 2016, and is also a continuation-in-part of International Patent Application No. PCT/EP2016/080371, filed Dec. 9, 2016, and claims the benefit of priority under 35 U.S.C. § 120 from these applications. This application also claims the benefit of priority under 35 U.S.C. § 119 from the following applications: European Patent Application No. 15199312.8, filed Dec. 10, 2015; European Patent Application No. 16159019.5, filed Mar. 7, 2016; European Patent Application No. 15199315.1, filed Dec. 10, 2015; and European Patent Application No. 16159022.9, filed Mar. 7, 2016. The disclosures of the foregoing applications are incorporated herein by reference in their entirety.

FIELD OF THE INVENTION

The present invention generally relates to a process for local surface treatment of textile material with a chemical composition, more specifically to the local treatment of a textile material with a nitrate salt and an acid catalyst and optionally with a laser in order to obtain a color change or a vintage look of the textile material at desired regions.

BACKGROUND ART

Fabric, such as denim, can be processed to simulate a worn look. Typically denim fabrics are ring dyed to enable the formation of a worn look when the colour from the most outer part of the yarn is physically or chemically removed. Common dyes for the denim textile are sulphur dyes, reactive dyes, direct dyes, VAT dyes, basic dyes, pigment dyes, or natural dyes. A combination of different dyes is possible and can emerge as top or bottom indigo combination dye, coatings, or bottoms. Indigo and sulphur dyes are most common on our fabric type. They emerge as solid dyed, top or bottom indigo combination dyed. Reactive dyes are used very often because of their wide colour offering and range together with their high fastness which is not always an advantage. Direct dyes can also be used and are not so fast on cotton as reactive. This often is desired to achieve a distressed washed out look. VAT dyes—such as indigo—are used on cotton and blends with other man-made fibers. Pigment dyes are often used in conjunction with a cationiser. Surface dyeing so compliments the indigo abrasion concept. Has limitations on darker shades since often a reactive bottom is used. Natural dyes are also possible depending on the desired effect. Conventionally, wet processes, such as a stone and/or enzyme process, are applied to the fabric, typically after the fabric has been transformed into a garment, to create a faded and worn look. Specifically, an enzyme wash in combination with agitation elements, such as stones or rocks, removes color from a ridged blue denim fabric to develop a contrasting pattern of variable color intensities creating a stonewashed look. In an exemplary embodiment, the faded areas of the denim fabric can correspond to where stones or rocks contact the fabric during the enzyme washing process.

However, traditional stonewash and/or enzyme processes have numerous drawbacks. For example, each manufacturing cycle requires extensive time to create the stonewashed look in which a significant amount of water is used during the process. In addition, the handling and disposal of the enzymes and wastewater can require substantial attention regarding environmental concerns.

U.S. Pat. No. 5,350,423 A discloses a process for pretreating cotton denim to enhance abrasion and shade reduction by embrittling the fibers with an acid and heat-activated finishing, thus increasing susceptibility/amenability of the indigo dye to a subsequent bleaching method (e.g. chlorine bleaching) and thereby reducing stonewashing time and expense.

EP 1 486 607 A1 discloses a process for an indigo-dyed cloth in which a sole nitrogen based oxidizing agent is applied. In order to obtain the desired vintage look the pretreated cloth is subjected to a dramatic heating step higher 170° C.

JP 2004 068179 A discloses a process for an indigo dyed cloth in which an acid compound is applied to a fabric by immersion and subjected to a heating step at very high baking temperature (180° C.) for the embrittlement of the cellulose backbone by acid hydrolysis and eventually physical removal of indigo dye.

JP H11 200261 A discloses the use of aqueous nitric acid to be applied onto indigo-dyed denim and achromatic (white) cloth by immersion and subsequent basic rinsing in order to achieve light-brown cotton goods after nitrification of the cellulose backbone. In this application the cloth is immersed completely into the solution and no local bleaching is possible.

A $CO_2$ laser treatment has been used for several years for surface designing of patterns. The $CO_2$ laser treatment is a dry treatment and can be applied to textile materials as an alternative to conventional dry and wet treatments such as hand sanding, sand blasting, stone washing and bleaching, for achieving faded look and worn out effects.

U.S. Pat. No. 5,567,207 discloses a method for making and fading textile with lasers. The laser is used to simulate conventional laundering techniques, such as stone washing, ball washing and acid washing, without the use of water or chemicals. The laser burns the surface of the denim fabric. Depending on the intensity of the laser every color from blue or black to complete white can be achieved. The lighter the bleaching effect is, the more dramatic is the fiber damage, which can cause breaking of the fabric.

U.S. Pat. No. 6,819,972 discloses a laser method to simulate the abrasion effect of a worn look. The patent teaches to define a desired pattern of color alterations to be formed on a garment by selecting a plurality of areas on a display and to associate a level of abrasion with each area. The patent further teaches to change the energy density per unit time along a single scan line in order to achieve the feathering required to simulate the worn look. Lasers operating in this fashion can simulate the worn look, but the garments often need to be processed after the laser treatment with hand sanding and/or potassium permanganate in order to improve abrasion intensity and pattern characteristics. Further, to achieve the worn look on a pair of jeans, the laser time may exceed several minutes with a conventional 100-200 watt laser in order to achieve the required energy intensity. Higher power lasers from 500 to 2,500 watts can on the one hand significantly reduce the time, but on the other hand require larger capital investments.

Currently one leading company in the laser treatment of textiles offers a process to laser abrade the worn look pattern on the jean twice. Once at the beginning of the wash cycle, followed by washing and drying of the garment, and then again laser abrasion of the previous worn look pattern on the washed garment in order to increase the abrasion effect and gain the desired intensity Therefore there is still the need for an improved method at lower temperature (e.g. by catalysis) and a technical as well as chemical solution for rendering local surface-treatment possible in order to impart a fabric a local vintage look.

SUMMARY OF INVENTION

It is the objective of the present invention to provide for localized bleaching of dyed goods by using nitric compounds for chemically bleaching dyestuff on fabrics.

The object is solved by the subject of the present invention.

According the invention there is provided a method for changing the color of a fiber, yarn, fabric or garment in order to obtain a vintage look, wherein said fiber, yarn, fabric or garment is subjected to a treatment with a nitrogen compound in presence of an acid catalyst or treatment conditions which induce acid formation.

One embodiment of the invention relates to a method for changing the color of a dyed textile material to obtain a vintage and/or worn appearance comprising the steps of:

a. contacting said textile material with at least one nitrate salt,
b. activating said nitrate salt by the addition of an acid catalyst, and
c. maintaining step b) until the desired color change is achieved.

A further embodiment of the invention relates to the method as described above, wherein the nitrate salt is an organic or inorganic nitrate salt.

A further embodiment of the invention relates to the method as described above, wherein the inorganic nitrate salt is selected from the group consisting of $Mg(NO_3)_2$, $KNO_3$, $LiNO_3$, $Al(NO_3)_3$, $Ca(NO_3)_2$, $Fe(NO_3)_3$, $Cu(NO_3)_2$, $Co(NO_3)_2$, $(NH_4)_2Ce(NO_3)_6$, $NaNO_3$, $RbNO_3$, $CsNO_3$, $Sr(NO_3)_2$, $Ba(NO_3)_2$, $Sc(NO_3)_3$, $Ti(NO_3)_4$, $Zr(NO_3)_4$, $VO(NO_3)_3$, $Cr(NO_3)_3$, $Mn(NO_3)_2$, $Co(NO_3)_2$, $Co(NO_3)_3$, $Ni(NO_3)_2$, $Pd(No_3)_2$, $AgNO_3$, $Cd(NO_3)_2$, $Hg_2(NO_3)_2$, $Hg(NO_3)_2$, $[B(NO_3)_4]^-$, $Ga(NO_3)_3$, $Tl(NO_3)_3$, $Pb(NO_3)_2$, $Bi(NO_3)_3$, $FNO_3$, $ClNO_3$, $Xe(NO_3)_2$, $Ce(NO_3)_3$, $Ce(NO_3)_4$, $Gd(NO_3)_3$.

A further embodiment of the invention relates to the method as described above, wherein the nitrate salt is $Mg(NO_3)_2$, $KNO_3$, $LiNO_3$, $NaNO_3$, $Al(NO_3)_3$, $Ca(NO_3)_2$, $Fe(NO_3)_3$, $Cu(NO_3)_2$, $Zn(NO_3)_2$, $Co(NO_3)_2$, or $(NH_4)_2Ce(NO_3)_6$.

A further embodiment of the invention relates to the method as described above, wherein the nitrate salt is applied in solution, wet or dry form.

A further embodiment of the invention relates to the method as described above, wherein nitrate salt is applied on local parts of the fabric.

A further embodiment of the invention relates to the method as described above, wherein the nitrate salt is applied on local parts of the fabric in a way whereupon figurative patterns are obtained.

One embodiment of the invention relates to a method for changing the color of a dyed textile material to obtain a vintage and/or worn appearance comprising the steps of:

a. contacting said textile material with at least one nitrate salt, wherein the nitrate salt is $Mg(NO_3)_2$, $KNO_3$, $LiNO_3$, $NaNO_3$, $Al(NO_3)_3$, $Ca(NO_3)_2$, $Fe(NO_3)_3$, $Cu(NO_3)_2$, $Co(NO_3)_2$, or $(NH_4)_2Ce(NO_3)_6$,
b. activating said nitrate salt by a heating step, and
c. maintaining step b) until the desired color change is achieved.

A further embodiment of the invention relates to the method as described above, wherein the acid catalyst is an organic or inorganic acid, preferably selected from the group consisting of methanesulfonic acid, citric acid, tartaric acid, oxalic acid, toluenesulfonic acid, succinic acid, maleic acid, malic acid, sulfuric acid, hydrochloric acid, phosphoric acid, salicylic acid and mixtures thereof and optionally about 0.01-15 vol % of at least one auxiliary agent.

A further embodiment of the invention relates to the method as described above, wherein the acid catalyst is selected from the group consisting of organic or inorganic compounds, i.e. organic or inorganic chlorides, sulfates, phosphates, borates, fluorides; acid forming esters, amino acid hydrochlorides, and Lewis acid chlorides.

A further embodiment of the invention relates to the method as described above, wherein the Lewis acid chloride is ferric chloride, zinc chloride, lithium chloride, copper chloride, magnesium chloride or aluminum chloride and a sulfate as magnesium sulfate, iron sulfate, iron sulfate, cerium sulfate, vanadium sulfate, copper sulfate, lithium sulfate, aluminum sulfate, potassium aluminum sulfate, ammonium aluminum sulfate, sodium sulfate, sodium hydrogen sulfate, zinc sulfate and manganese sulfate, and the phosphate is a monosodium phosphate, disodium phosphate, monopotassium phosphate, dipotassium phosphate, monomagnesium phosphate, dimagnesium phosphate, trimagnesium phosphate, ammonium polyphosphate, monoammonium phosphate, diammonium phosphate, monocalcium phosphate, dicalcium phosphate, disodium pyrophosphate, trisodium pyrophosphate, tetrasodium pyrophosphate, sodium triphosphate, pentapotassium triphosphate.

A further embodiment of the invention relates to the method as described above, wherein the acid catalyst is capsuled.

A further embodiment of the invention relates to the method as described above, wherein the treatment is carried out by a temperature of below 65° C., or at a temperature of below 90° C., or at higher temperature where applicable, if the acid catalyst decreases the activation temperature in comparison to the pure nitrate.

A further embodiment of the invention relates to the method as described above, wherein the textile material is treated with an aqueous solution comprising at least one nitrate salt which is activated by an acid catalyst, wherein the treatment is carried out until the desired color change is achieved.

A further embodiment of the invention relates to the method as described above, wherein said aqueous solution comprises $Mg(NO_3)_2$, a different nitrate salt (e.g. $Al(NO_3)_3$) and an acid catalyst, e.g. tartaric acid.

A further embodiment of the invention relates to the method as described above, wherein said aqueous solution comprises $Al(NO_3)_3$ and toluenesulfonic acid.

A further embodiment of the invention relates to the method as described above, wherein the fabric is not immersed into the aqueous solution.

A further embodiment of the invention relates to the method as described above, wherein the treatment is carried out at a temperature of about 10 to 90° C., or at a temperature of about 10 to 60° C., or at a temperature of about 10 to 50° C. or at room temperature.

A further embodiment of the invention relates to the method as described above, wherein the method is carried out in the presence of a sulfate and/or chloride compound.

One embodiment of the invention relates to the use of an aqueous composition comprising at least one nitrate salt and optionally at least one acid catalyst and optionally an auxiliary chemical agent for the treatment of textile material in order to obtain a worn appearance and/or vintage look.

A further embodiment of the invention relates to the use as described above, wherein the aqueous solution comprises about 10-75 vol % nitrate salt, optionally about 0.01-5 vol % of a different nitrate salt, and about 0.5-50.0 vol % acid catalyst, and optionally about 0.01-0.05 vol % of at least one chelating agent and optionally about 0.01-15 vol % of at least one auxiliary agent.

A further embodiment of the invention relates to the use as described above, wherein the aqueous solution comprises about 20-50 vol % nitrate salt, optionally about 0.05-3 vol % of a different nitrate salt, and about 1.0-35.0 vol % acid catalyst, and optionally about 0.01-0.05 vol % chelating agent and optionally about 0.01-15 vol % of at least one auxiliary agent.

A further embodiment of the invention relates to the use as described above, wherein the aqueous solution comprises about 20-35 vol % nitrate salt, optionally about 0.1-2 vol % of a different nitrate salt, and about 5.0-35.0 vol % acid catalyst, and optionally about 0.01-0.05 vol % chelating agent and optionally about 0.01-15 vol % of at least one auxiliary agent.

A further embodiment of the invention relates to the use as described above, wherein the aqueous solution comprises about 20-30 vol % $Mg(NO_3)_2$, about 0.05-2 vol % of another nitrate salt, about 1.0-30.0 vol % tartaric acid and optionally about 0.01-0.05 vol % chelating agent and optionally about 0.01-15 vol % of at least one auxiliary agent.

A further embodiment of the invention relates to the use as described above, wherein the aqueous solution comprises about 5-20 vol % $Al(NO_3)_3$, about 5 vol % butyl diglycol, mixing with a solution of about 10-35 vol % toluenesulfonic acid, and optionally about 0.01-0.05 vol % chelating agent and optionally about 0.01-15 vol % of at least one auxiliary agent.

A further embodiment of the invention relates to the use as described above, wherein the aqueous solution comprises about 10 vol % $Al(NO_3)_3$, about 5 vol % butyl diglycol, mixing with a solution of about 30 vol % toluenesulfonic acid, and optionally about 0.01-0.05 vol % chelating agent and optionally about 0.01-15 vol % of at least one auxiliary agent.

A further embodiment of the invention relates to the method as described above, wherein optionally an auxiliary agent is used.

A further embodiment of the invention relates to the method as described above, wherein the auxiliary agent is present in an amount of 0.01-15 vol %.

One embodiment of the invention relates to a method to increase the color value of treated fabric by applying a solution comprising about 0.1-20 vol % $Al(NO_3)_3$, optionally about 5 vol % butyl diglycol and about 0.01-35 vol % toluenesulfonic acid to the fabric depending on the intensity of the desired effect.

One embodiment of the invention relates to a method to increase the color value of laser treated fabric by using a solution comprising about 5-20 vol % $Al(NO_3)_3$, optionally about 5 vol % butyl diglycol, mixing it with a solution of about 10-35 vol % toluenesulfonic acid and applying it to the fabric, drying the fabric in a dryer at temperatures less than 60° C., applying a laser beam to the fabric to generate nitrogen oxide compounds, which attack the indigo dye and thereby create a color value change.

One embodiment of the invention relates to a method to increase the color value of treated fabric by applying a solution comprising about 0.1-20 vol % $Al(NO_3)_3$, optionally about 5 vol % butyl diglycol and about 30 vol % toluenesulfonic acid to the fabric depending on the intensity of the desired effect.

One embodiment of the invention relates to a method to increase the color value of laser treated fabric by applying a solution comprising about 0.1-20 vol % $Al(NO_3)_3$, optionally about 5 vol % butyl diglycol, and about 0.01-35 vol % toluenesulfonic acid to the fabric depending on the intensity of the desired effect, and drying the fabric (e.g. dryer, oven, fan, air dry, etc.) by selecting the temperature in such a way that the bleaching reaction does not take place in a significant way during the drying step (e.g. less than 60° C.), applying a laser beam to the fabric to generate nitrogen oxide compounds, which attack the indigo dye and thereby create a color value change.

One embodiment of the invention relates to a method to increase the color value of treated fabric by applying a solution comprising of an aluminum based nitrate salt, optionally a wetting agent, and toluenesulfonic acid to the fabric.

A further embodiment of the invention relates to a method to increase the color value of laser treated fabric by applying a solution comprising about 0.1-20 vol % $Al(NO_3)_3$, optionally about 5 vol % butyl diglycol, and about 30 vol % toluenesulfonic acid to the fabric depending on the intensity of the desired effect, and drying the fabric (e.g. dryer, oven, fan, air dry, etc.) by selecting the temperature in such a way that the bleaching reaction does not take place in a significant way during the drying step (e.g. less than 60° C.), applying a laser beam to the fabric to generate nitrogen oxide compounds, which attack the indigo dye and thereby create a color value change.

One embodiment of the invention relates to a method to increase the color value of laser treated fabric by applying a solution comprising an aluminum based nitrate salt, optionally a wetting agent, and toluenesulfonic acid to the fabric, drying the fabric, applying a laser beam to the fabric to generate nitrogen oxide compounds, which attack the indigo dye and thereby create a color value change.

One embodiment of the invention relates to a method to increase the color intensity of laser treated fabric by mixing a magnesium based nitrate salt with buffer compound containing a phosphoric acid or a carboxylic acid and the corresponding salt of this acid, and applying this solution to fabric, and drying the fabric in a dryer at temperatures less than 60° C., and applying a laser beam to the fabric to change the color intensity to value ranges of L from 15-40 to 30-60.

One embodiment of the invention relates to a method to increase the color intensity of laser treated fabric by mixing a magnesium based nitrate salt with catalyst, and applying this solution to fabric, and drying the fabric in a dryer at temperatures less than 60° C., and applying a laser beam to the fabric to change the color intensity to value ranges of L from 15-30 to 30-60.

One embodiment of the invention relates to a method to increase the color intensity of laser treated fabric by mixing a magnesium based nitrate salt with catalyst, and applying this solution to fabric, and drying the fabric (e.g. dryer, oven, fan, air dry, etc.) by selecting the temperature in such a way that the bleaching reaction does not take place in a significant way during the drying step (e.g. less than 60° C.), and applying a laser beam to the fabric to change the color intensity to value ranges of L from 15-30 to 30-60.

One embodiment of the invention relates to the use of an aqueous solution applied to fabric to increase the color value of laser treated fabric.

One embodiment of the invention relates to the use of an aqueous solution containing magnesium salt and at least one of a buffer or a catalyst, and applying the aqueous solution to fabric to increase the color value of laser treated fabric.

One embodiment of the invention relates to a method to achieve Lab color space value ranges for L from 15 to 100.

One embodiment of the invention relates to a method to achieve Lab color space lightness value ranges for L of from 20 to 60 by laser treating fabric that has been pretreated with magnesium salt mixed with either a buffer or catalyst.

One embodiment of the invention relates to a method to increase the Lab color space lightness value L by 2 points by laser treating the fabric that has been pretreated with magnesium salt mixed with either a buffer or catalyst compared to the untreated fabric.

One embodiment of the invention relates to a method to increase the Lab color space lightness value L by 2 points by laser treating the fabric that has been pretreated with nitrate salt mixed with either a buffer or catalyst compared to the untreated fabric.

One embodiment of the invention relates to a method as described above wherein the drying step b) results in a color change that is lower than a lightness value of the fabric by 2 points.

A further embodiment of the invention relates to the use as described above, wherein the auxiliary agent is selected from the group consisting of a nitrate, softener, brightening agent, plastic, a thickening agent, dyestuff used as a marker dye, a wetting agent, a complexing agent, a dispersing agent, and a buffer solution derived from the salt of an acid and the corresponding acid.

A further embodiment of the invention relates to the method as described above, wherein the fabric is dyed by commonly used dyes for the textiles.

A further embodiment of the invention relates to the method as described above, wherein the dye is selected from the group consisting of sulphur dye, reactive dye, direct dye, VAT dye, basic dye, pigment dye, or natural dyes, or a mixture thereof.

A further embodiment of the invention relates to the method as described above, wherein the dye is a solid dye of a top or bottom indigo combination dye.

A further embodiment of the invention relates to the method as described above, wherein the $\Delta L$ value between the untreated and treated part is greater than 2. L stands for the lightness in the CIE 1976 Lab color space.

A further embodiment of the invention relates to the method as described above, wherein the acid catalyst is provided as a buffered substance.

A further embodiment of the invention relates to the method as described above, wherein the pH of the aqueous solution is higher than 2.

DESCRIPTION OF EMBODIMENTS

In order to obtain a worn or vintage look of fabrics currently large amounts of chemicals and water are required which are harmful to the environment.

Therefore the present invention provides a method for obtaining a worn and/or vintage appearance of a fabric in which the shortcomings of the prior art are avoided.

The invention discloses a novel combination of a non-hazardous chemical treatment to denim followed by a laser treatment which together provide the abrasion intensity to simulate the worn out look on denim jeans without the use of the dangerous potassium permanganate chemical. Surprisingly, other unexpected benefits were realized from this invention in terms of increased laser throughput and/or reduced laser power requirements which leads to less damage of man-made fibers of e.g. blends like cotton with polyester, elastane, etc.

The present invention relates to a method of providing a worn or vintage appearance of a fabric, wherein said fabric is subjected to acid treatment in the presence of a nitrate salt.

In the present invention the term "textile material" or "fabric" are used interchangeably and refer to fibers, yarns, fabrics, flexible knitted, woven or non-woven material consisting of a network of natural or artificial fibers (yarn or thread). The textile material may be used in production of further goods (cloths, garments, carpets, bags, shoes, jewelry, furnishings, artifacts, etc.).

In one embodiment of the invention the textile material is finished colored denim. In one further embodiment of the invention the method may be applied to a variety of garments including jeans, jean jackets, jean skirts, jean shorts, jean dresses, jean vests, corduroy and twill garments. The method may also be applied on other fabrics besides denim fabrics.

The textile material may be dyed or coated with a dye, preferably with a natural or synthesized dye. In one embodiment of the invention the fabrics are dyed with an indigo dye which may be a natural or synthesized indigo dye or sulphur black dye. In another embodiment of the invention the yarns of the fabrics are dyed with sulphur black dyes, a combination of indigo dye and sulphur black dye or a combination of sulphur black below, in-between and on top of the indigo dye on the yarn.

The textile material may consist of cellulosic material (e.g. natural fibers like bast fibers (e.g. jute, flax, hemp, etc.), leaf fibers (e.g. sisal, etc.), seed fibers (e.g. cotton, etc.), or other fibers like bamboo, etc., or man-made fibers like lyocell type, viscose and rayon type, or modal type, cupro type, acetate type), and in special cases also fibers based on proteins (e.g. soja, casein, fibroin, sericin, etc.), starch and glucose (e.g. polylactide fibers, etc.), alginates and chitosanes, but not limited to, and may be used in a combination of synthetic fiber types derived from polycondensation (e.g. polyester, polyethyleneterephtalate, polyamide, polyimide, polyamide-imide, polyphenylensulfide, aramide, etc.), polymerization (e.g. polyacrylonitrile, polytetrafluorethylene, polyethylene, polypropylene, polyvinylchloride, etc.) and fibers produced by polyaddition procedure (e.g. polyurethane, etc.), but not limited to.

By the inventive combination of an aqueous nitrate salt treatment in the presence of an acid catalyst the additional activating step by heating above 100° C. is needless.

The nitrogen compound may be an organic nitro- or nitrate-compound like aliphatic, aromatic, heterocyclic or a biochemical organic compound selected from the group consisting of alkanes, alkenes, alkynes, cyclic compounds, as well as allyl-, alkyl-, arylcompounds, alcohols, aldehydes, esters, ethers, ketones, carbohydrates, or inorganic nitrates of heavy metals or of an alkali-metal, alkaline earth metal, or one of the boron group, carbon group, nitrogen group, chalcogens, halogens, noble gases, as well as from the group of transition metals, Lanthanides and Actinides.

In one embodiment of the invention the nitrogen compound is a nitrate salt which is selected from the group consisting of $Mg(NO_3)_2$, $KNO_3$, $LiNO_3$, $Al(NO_3)_3$, $Ca(NO_3)_2$, $Fe(NO_3)_3$, $Cu(NO_3)_2$, $Zn(NO_3)_2$, $Co(NO_3)_2$, $(NH_4)_2Ce(NO_3)_6$, $NaNO_3$, $RbNO_3$, $CsNO_3$, $Be(NO_3)_2$, $Sr(NO_3)_2$, $Ba(NO_3)_2$, $Sc(NO_3)_3$, $Ti(NO_3)_4$, $Zr(NO_3)_4$, $VO(NO_3)_3$, $Cr(NO_3)_3$, $Mn(NO_3)_2$, $Co(NO_3)_3$, $Ni(NO_3)_2$, $Pd(NO_3)_2$, $AgNO_3$, $Cd(NO_3)_2$, $Hg_2(NO_3)_2$, $Hg(NO_3)_2$, $[B(NO_3)_4]^-$, $Ga(NO_3)_3$, $Tl(NO_3)_3$, $Pb(NO_3)_2$, $Bi(NO_3)_3$, $FNO_3$, $ClNO_3$, $Xe(NO_3)_2$, $Ce(NO_3)_3$, $Ce(NO_3)_4$, $UO_2(NO_3)_2$, $Gd(NO_3)_3$, as well as their salts with nitrite.

In one embodiment of the invention the nitrate salt is selected from the group consisting of $Mg(NO_3)_2$, $LiNO_3$, $Al(NO_3)_3$, $Fe(NO_3)_3$, $Zn(NO_3)_2$, $Ce(NO_3)_3$, $Ce(NO_3)_4$, as well as their respective salts with nitrite.

The nitrate salt may be used in a concentration of higher than 0.5 g/L, limited by its solubility in the solvent. In one embodiment a mixture of nitrate salts is used. In one further embodiment the nitrate salt or mixture is used in a dry form, e.g. as a powder.

Appropriate solvents are polar and/or low-polarity solvents as primary solvents or as mixtures or emulsions in any desired ratio, such as water, alcohols, fatty alcohols, aliphatic fatty alcohols, aromatic fatty alcohols, amines, octylamines, cyclic amines, hydrocarbon solvents, naphthenic solvents, paraffinic solvents, aromatic derivatives such as diisopropylnaphthalene, glycols, polyglycols, esters, branched monoesters, oleic esters, benzoic esters, lactic acid esters, myristic acid esters, palmitic acid esters, fatty acid esters in general, propylene glycol acetates, dipropylene glycol ether acetate, polyethylene glycol acetates, diethylene glycol monobutyl ether acetate, glycol ethers, polypropylene glycol esters, tripropylene glycol monomethyl ether, dipropylene glycol monopropyl ether, dipropylene glycol monobutyl ether, propylene glycol phenyl ether, tripropylene glycol monobutyl ether and polyethylene glycol ethers, hexyl carbitol ether, phenols, alkylphenols, fatty acids, terpene alcohols, terpene oils, copolymers of vinylpyrrolidone, polyglycols and polypropylene glycol. The solvent may further include additives such as dispersants, wetting agents, anti-foaming agents, softeners, plastics, thickeners, etc.

The acid may be an Arrhenius acid, Brønsted-Lowry acid or a Lewis acid, chemically characterized as monoprotic or polyprotic acids or salts thereof which may be mineral acids (inorganic acids) or organic acids like sulfonic acids or salts thereof, aliphatic or aromatic carboxylic acids, amino acids, halogenated carboxylic acids and vinylogous carboxylic acid or salts thereof. In one embodiment of the invention the acid may be selected from the group consisting of sulfuric acid, hydrochloric acid, fluorosulfuric acid, phosphoric acid, fluoroantimonic acid, fluoroboric acid, hexafluorophosphoric acid, chromic acid, boric acid, methanesulfonic acid, ethanesulfonic acid, amidosulfonic acid, sulfamidic acid, sulfanilic acid, benzenesulfonic acid, toluenesulfonic acids, trifluoromethanesulfonic acid, polystyrene sulfonic acid, acetic acid, citric acid, formic acid, gluconic acid, glycolic acid, lactic acid, tartaric acid, oxalic acid, maleic acid, pyruvic acid, benzoic acid, gallic acid, barbituric acid, dihydroxybenzoic acid, cinnamic acids, aminobutyric acid, fumaric acid, malic acid, succinic acid, malonic acid, glutaminic acid, nitrosalicylic acid, nitrobenzoic acids, nitrobenzenesulfonic acid, levolinic acid, pimelic acid, salicylic acid, sulfosalicylic acid, adipic acid, caprylic acid, nicotinic acids, uric acid, phthalic acid, chloroacetic acid, fluoroacetic acid, trifluoroacetic acid, chloroacetic acid, dichloroacetic acid, trichloroacetic acid, ascorbic acid, aspartic acid, and mandelic acid. Mixtures of two or more of these compounds may also be used, as well as in a combination with corresponding salts to form buffer solutions.

The acid catalyst may be for example selected from the group consisting of organic or inorganic compounds, i.e. organic or inorganic forms of chlorides, sulfates, phosphates, borates, fluorides, Lewis acid chlorides, such as ferric chloride, zinc chloride and aluminum chloride, magnesium chloride, ammonium chloride, potassium aluminum sulfate, ammonium sulfate, maleate ester, an amino acid hydrochloride, such as glycine hydrochloride, glutamic acid hydrochloride, betaine hydrochloride, alanine hydrochloride, valine hydrochloride, lysine hydrochloride, arginine hydrochloride, or aspartic acid hydrochloride.

Suitable acid catalysts include organic acids such as citric acid and tartaric acid. Magnesium chloride, ammonium chloride, zinc chloride, zinc fluoroborate and zinc nitrate are suitable (weak) acids, as well as water soluble salts of mono-, di-, tri- and polyphosphates (e.g. monosodium phosphate, disodium phosphate, trisodium phosphate, monopotassium phosphate, dipotassium phosphate, tripotassium phosphate, monomagnesium phosphate, dimagnesium phosphate, trimagnesium phosphate, ammonium polyphosphate, monoammonium phosphate, diammonium phosphate, triammonium phosphate, monocalcium phosphate, dicalcium phosphate, tricalcium phosphate, disodium pyrophosphate, trisodium pyrophosphate, tetrasodium pyrophosphate, sodium triphosphate, pentapotassium triphosphate), and pyrophosphates or organophosphates which are esters of phosphoric acid and phytinic acid and their corresponding salts; as well as complexing agents which may be but not limited to selected from the list of methylglycindiacetic acid, ethylenediaminetetraacetic acid, L-glutamic acid N,N-diacetic acid tetra sodium salt, alanine-N,N-diacetic acid trisodium salt, diethylene triamine pentaacetic acid, nitrilotriacetic acid, ethylene glycol tetraacetic acid, ethylenediamine-N,N'-disuccinic acid, polycarboxylates, zeolithes, and phosphonates. Mixtures of two or more of these compounds may also be used, as well as in combination to form buffer solutions.

Preferred solute concentrations of the acid depend upon the particular acid catalysts used. Lower concentrations of highly active compounds may be used to avoid unwanted acid damage to the fabric and higher concentrations of less active compounds.

The solution of the acid together with the nitrate is preferably an aqueous solution, but it may be also applied in separate steps or in a mixture of the pure substances in powder form. One or more components may be encapsulated in the solution or the solid form. The textile material may be evenly or unevenly impregnated with this composition using any of the conventional techniques.

The application of one or more components together or in separate form on the fibers, yarns, fabrics or garments may be performed by immersion, padding, spraying, brushing, printing, foaming, sponging, other contact methods like stone and/or powder carrier, but not limited to, at any stage of processing. In one embodiment of the invention the aqueous solution is sprayed on the raw or desized denim garment on limited areas, or covering all parts of the garment, to create localized bleached effects simulating wear areas on the jeans or applied on prepared shaped motif to jeans or fabric which can be subsequently washed to highlight the applied areas. In another embodiment of the invention the solution may be applied on fabric form by immersion or as a one side application by printing (e.g. as block printing or roller cage printing), spraying, foaming, or a kiss roll on all areas of the application side or on limited areas of the application side.

The acid catalyst may be applied in a concentration of higher than 0.01 g/L, limited by its solubility in the solvent. In one embodiment a mixture of acids may be used.

In one embodiment of the invention the ratio of acid catalyst to the nitrate salt in the reaction mixture is in the range of about 75:1 to 1:100, preferably in the range of about 20:1 to 1:20, more preferably in the range of 5:1 to 1:20, most preferred in the range of 1:1 to 1:5.

Additionally one or more further catalysts may be added to the reaction mixture such as for example a sulfate compound, phosphate compound, ammonium compound and/or a chloride compound, or mixtures thereof.

In one embodiment of the invention addition of a buffer solution might be appropriate. Suitable buffer solutions are well known to a person skilled in the art.

In one embodiment of the invention the method is carried out in the presence of a sulfate, a phosphate and/or chloride catalyst. The sulfate may be selected from the group consisting of $MgSO_4$, $Ce(SO_4)_2$, $VOSO_4$, $FeSO_4$, $Fe_2(SO_4)_3$, $CuSO_4$, $KAl(SO_4)_2$, $Al_2(SO_4)_3$, $ZnSO_4$, $NaHSO_4$, $KHSO_4$, $Li_2SO_4$, $CaSO_4$. The phosphate may be selected from the group of calcium, sodium, potassium and ammonium phosphates such as $NaH_2PO_4$, $Na_2HPO_4$, $KH_2PO_4$, $K_2HPO_4$, $Ca(H_2PO_4)_2$, $CaHPO_4$, $Na_2H_2P_2O_7$, $Na_3HP_2O_7$, $Na_5P_3O_{10}$, $K_5P_3O_{10}$, $(NH_4)H_2PO_4$, $(NH_4)_2HPO_4$. The chloride may be selected from heavy metal chloride such as for example from $ZnCl_2$, $FeCl_3$, $FeCl_2$, $CuCl_2$, $MnCl_2$, $CoCl_2$, $NiCl_2$ or $AlCl_3$.

In one embodiment of the invention the textile material is treated with $Mg(NO_3)_2$ in the presence of methanesulfonic acid for about 30 min.

In one embodiment of the invention the textile material is treated with $Mg(NO_3)_2$ in the presence of tartaric acid and another nitrogen compound for about 20 min at a temperature of about 60° C.

In one embodiment of the invention the textile material is treated with an aqueous solution comprising at least one nitrate salt—depending on the cation species—in a concentration of about 1-80 vol %, or of about 5-75 vol %. In one embodiment of the invention the aqueous solution comprises at least one nitrate salt in a concentration of about 1 vol %, 2.5 vol %, 5 vol %, 7.5 vol %, 10 vol %, 15 vol %, 18 vol %, 20 vol %, 25 vol %, 26.6 vol %, 28 vol % 30 vol %, 32.5 vol %, 35 vol %, 38.5 vol %, 40 vol %, 42.5 vol %, 45 vol %, 47.5 vol %, 50 vol %, 51 vol %, 52 vol %, 55 vol %, 57 vol %, 60 vol %, 62.5 vol %, 65 vol %, 67.5 vol %, 70 vol %, 72.5 vol %, or 75 vol %.

In a further embodiment of the invention the aqueous solution comprises at least one nitrate salt in a concentration as stated about, wherein said nitrate salt is selected from the group consisting of $Mg(NO_3)_2$, $LiNO_3$, $Al(NO_3)_3$, $Ca(NO_3)_2$, $Fe(NO_3)_3$, $Cu(NO_3)_2$, $KNO_3$, $NaNO_3$, $(NH_4)_2Ce(NO_3)_6$, $Co(NO_3)_2$, or $Fe(NO_3)_2$, or hydrates thereof. Optionally, the aqueous solution may also comprise auxiliary agents.

In a further embodiment of the invention the aqueous solution comprises at least one nitrate salt in a concentration as stated above and at least one acid catalyst in a concentration of about 0.01 vol %, 0.05 vol %, 1.0 vol %, 1.25 vol %, 1.5 vol %, 1.75 vol %, 2.0 vol %, 2.25 vol %, 2.5 vol %, 2.75 vol %, 3.0 vol %, 3.25 vol %, 3.5 vol %, 3.75 vol %, 4.0 vol %, 4.25 vol %, 4.5 vol %, 4.75 vol %, 5.0 vol %, 5.25 vol %, 5.5 vol %, 5.75 vol %, 6.0 vol %, 6.25 vol %, 6.5 vol %, 6.76 vol %, 7.0 vol %, 7.25 vol %, 7.5 vol %, 7.75 vol %, 8.0 vol %, 8.25 vol %, 8.5 vol %, 8.75 vol %, 9.0 vol %, 9.25 vol %, 9.5 vol %, 9.75 vol %, 10.0 vol %, 11.0 vol %, 12.0 vol %, 13.0 vol %, 14.0 vol %, 15.0 vol %, 17.5 vol %, 20.0 vol %, 22.5 vol %, or 25.0 vol %.

In a further embodiment of the invention the aqueous solution comprises at least one nitrate salt and at least one acid catalyst in a concentration as stated above, wherein said acid catalyst is selected from the group consisting of $MgSO_4$, $Ce(SO_4)_2$, $VOSO_4$, $FeSO_4$, $Fe_2(SO_4)_3$, $ZnCl_2$, $FeCl_3$, $CuCl_2$, $FeCl_2$, $AlCl_3$, $LiNO_3$, $CaCl_2$, NaCl, KCl, LiCl, $SrCl_2$, $MgCl_2$, $(NH_4)_2SO_4$, $CuSO_4$, $Li_2SO_4$, $NH_4Al(SO_4)_2$, $KAl(SO_4)_2$, $ZnSO_4$, $NaH_2PO_4$, $Na_2HPO_4$, $KH_2PO_4$, $K_2HPO_4$, $Zn_3(PO_4)_2$, $Ca(H_2PO_4)_2$, $CaHPO_4$, $Na_2H_2P_2O_7$, $Na_3HP_2O_7$, $Na_5P_3O_{10}$, $K_5P_3O_{10}$, $(NH_4)H_2PO_4$, $(NH_4)_2HPO_4$ or hydrates thereof. Optionally, the aqueous solution may also comprise auxiliary agents.

In a further embodiment of the invention the aqueous solution comprises at least one nitrate salt in a concentration as stated above and at least one acid catalyst in a concentration of about 0.01 vol %, 0.05 vol %, 1.0 vol %, 1.25 vol %, 1.5 vol %, 1.75 vol %, 2.0 vol %, 2.25 vol %, 2.5 vol %, 2.75 vol %, 3.0 vol %, 3.25 vol %, 3.5 vol %, 3.75 vol %, 4.0 vol %, 4.25 vol %, 4.5 vol %, 4.75 vol %, 5.0 vol %, 5.25 vol %, 5.5 vol %, 5.75 vol %, 6.0 vol %, 6.25 vol %, 6.5 vol %, 6.76 vol %, 7.0 vol %, 7.25 vol %, 7.5 vol %, 7.75 vol %, 8.0 vol %, 8.25 vol %, 8.5 vol %, 8.75 vol %, 9.0 vol %, 9.25 vol %, 9.5 vol %, 9.75 vol %, 10.0 vol %, 11.0 vol %, 12.0 vol %, 13.0 vol %, 14.0 vol %, 15.0 vol %, 16.0 vol %, 17.0 vol % 18.0 vol %, 19.0 vol %, 20.0 vol %, 22.5 vol %, 25.0 vol %, 27.5 vol %, 30.0 vol %, 32.5 vol %, 35.0 vol %, 37.5 vol %, 40.0 vol %, 42.5 vol %, 45.0 vol %, 47.5 vol %, or 50.0 vol %.

In a further embodiment of the invention the aqueous solution comprises at least one nitrate salt in a concentration as stated above and at least one acid catalyst, wherein said acid catalyst is selected from the group consisting of methanesulfonic acid ($CH_3SO_3H$), phosphoric acid, citric acid, tartaric acid, oxalic acid, HCl, maleic acid, $H_2SO_4$, lactic acid, succinic acid or malonic acid. Optionally, the aqueous solution may also comprise auxiliary agents.

In a further embodiment of the invention the aqueous solution comprises at least one nitrate salt, at least one acid in respective concentrations as stated above and optionally auxiliary agents.

In a further embodiment of the invention the aqueous solution comprises at least one nitrate salt, optionally at least one acid catalyst in respective concentrations as stated above and a thickening agent in a concentration of about 0.01-1 vol %, of about 0.05-0.75 vol %, or of about 0.1-0.5 vol %. Preferably, the thickening agent is modified starch, modified cellulose, alginate or xanthan gum, but also hyaluronic acid, gelatin (collagen), pectin, agar (agarose), guar gum, gum arabic, carrageenan, locust bean gum (galactomannan), tragacanth and gellan gum.

In a further embodiment of the invention the aqueous solution comprises at least one nitrate salt, optionally at least one acid catalyst, and additionally auxiliary chemical agents in a concentration of about 0.001-25 vol %, of about 0.01-7.7 vol %, or of about 0.025-5.0 vol %. Preferably, the auxiliary component in respective concentrations as stated above is selected from the group consisting of a nitrate, softener, brightening agent, plastic, a thickening agent, dyestuff used as a marker dye, a wetting agent, a complexing agent, a dispersing agent, and buffer components being derived from the salt of an acid and/or the corresponding acid.

In a further embodiment of the invention the aqueous solution comprises at least one nitrate salt, optionally at least one acid and optionally a thickening agent in respective concentrations as stated above and additionally auxiliary chemicals in a concentration of about 0.001-10 vol %, of about 0.05-7.7 vol %, or of about 0.1-5.0 vol %. Preferably, the auxiliary component is selected from the group consisting of a polysorbate, alkyl polyglucoside, methyl red, chromene red, monosodium phosphate, disodium pyrophosphate, tetrasodium diphosphate, butyl diglycol, sodium dodecyl sulfate, sodium olefin sulfonate, sodium laureth sulfate, sodium lauryl ether sulfate, alanine-N,N-diacetic acid trisodium salt, glutamine-N,N-diacetic acid trisodium salt, DMSO and sulfolane. Respective softeners are fatty alcohol polyglycol ether, acrylic acid, 3,5,7-trimethyldecane, soap, triglycerides, polydimethylsiloxane, cyclopentasiloxane, emulsifiers, lignosulfonate, cationic surfactants, anionic surfactants, esterquats, ionic liquids, sodium 2-ethylhexyl sulfate, 2-methyl-2,4-pentanediol, tributyl phosphate, triisobutyl phosphate, 1-hydroxyethane-1,1,-diphosphonic acid (HEDP), 2,2-dimethyl-1,3-propanediol. Oxidizers as respective additives could be peroxides, peroxy acids and/or persulfates.

In a further embodiment of the invention the aqueous solution comprises $Mg(NO_3)_2$, optionally a different nitrate salt, and optionally a complexing agent. Tartaric acid is added to create the used/vintage look.

In a further embodiment of the invention the aqueous solution comprises about 26 vol % $Mg(NO_3)_2$, about 0.05-0.1 vol % of a different nitrate salt, and optionally about 0.01-0.05 chelating agent. About 1.0-10.0 vol % tartaric acid is added to create the used/vintage look. The composition may further include about 0.01-15 vol % of at least one auxiliary agent selected from the group consisting of a nitrate, a thickening agent, dyestuff used as a marker dye, a wetting agent, a complexing agent, a dispersing agent, and a buffer solution being derived from the salt of an acid and the corresponding acid.

A further embodiment of the invention relates to the use of an aqueous composition comprising at least one nitrate salt and optionally at least one acid and/or auxiliary agent for the treatment of textile material in order to obtain a used and/or vintage look.

A further embodiment of the invention relates to the use of an aqueous composition comprising at least one nitrate salt and at least one acid catalyst for the treatment of textile material in order to obtain a used and/or vintage look, wherein the acid catalyst is selected from the group consisting of $MgSO_4$, $Ce(SO_4)_2$, $VOSO_4$, $FeSO_4$, $Fe_2(SO_4)_3$, $ZnCl_2$, $FeCl_3$, $CuCl_2$, $FeCl_2$, $AlCl_3$, $LiNO_3$, $CaCl_2$, NaCl, KCl, LiCl, $SrCl_2$, $MgCl_2$, $(NH_4)_2SO_4$, $CuSO_4$, $Li_2SO_4$, $NH_4Al(SO_4)_2$, $KAl(SO_4)_2$, $Zn_3(PO_4)_2$, $NaH_2PO_4$, $Na_2HPO_4$, $KH_2PO_4$, $K_2HPO_4$, $Ca(H_2PO_4)_2$, $CaHPO_4$, $Na_2H_2P_2O_7$, $Na_3HP_2O_7$, $Na_5P_3O_{10}$, $K_5P_3O_{10}$, $(NH_4)H_2PO_4$, $(NH_4)_2HPO_4$, or hydrates thereof.

A further embodiment of the invention relates to the use of an aqueous composition comprising at least one nitrate salt and at least one acid catalyst for the treatment of textile material in order to obtain a used and/or vintage look, wherein the acid catalyst is selected from the group consisting of methanesulfonic acid ($CH_3SO_3H$), citric acid, tartaric acid, oxalic acid, HCl, maleic acid, $H_2SO_4$, lactic acid, or malonic acid or mixtures thereof.

A further embodiment of the invention relates to the use of an aqueous composition comprising at least one nitrate salt and at least one acid catalyst for the treatment of textile material in order to obtain a used and/or vintage look, wherein the acid catalyst and/or acidic buffer component is selected from the group consisting of $MgSO_4$, $Ce(SO_4)_2$, $VOSO_4$, $FeSO_4$, $Fe_2(SO_4)_3$, $ZnCl_2$, $FeCl_3$, $CuCl_2$, $FeCl_2$, $AlCl_3$, $CaCl_2$, NaCl, KCl, LiCl, $SrCl_2$, $MgCl_2$, $(NH_4)_2SO_4$, $CuSO_4$, $Li_2SO_4$, $NH_4Al(SO_4)_2$, $KAl(SO_4)_2$, $Zn(NO_3)_2$, $NaH_2PO_4$, $Na_2HPO_4$, $KH_2PO_4$, $K_2HPO_4$, $Ca(H_2PO_4)_2$, $CaHPO_4$, $Na_2H_2P_2O_7$, $Na_3HP_2O_7$, $Na_5P_3O_{10}$, $K_5P_3O_{10}$, $(NH_4)H_2PO_4$, $(NH_4)_2HPO_4$ or hydrates thereof, or wherein the acid catalyst is selected from the group consisting of methanesulfonic acid, toluenesulfonic acid, citric acid, tartaric acid, oxalic acid, HCl, maleic acid, $H_2SO_4$, lactic acid, succinic acid or malonic acid, and optionally comprising at least one further auxiliary chemical and/or thickening agent.

A further embodiment of the invention relates to the use of an aqueous solution comprising about 26 vol % $Mg(NO_3)_2$, about 0.05 vol % of another nitrate, about 2.0 vol % tartaric acid and optionally about 0.01 vol % chelating agent for the treatment of textile material in order to obtain a used look, a vintage look or a change in the color, optionally on preselected areas of the textile material.

A further embodiment of the invention relates to the use of an aqueous solution comprising about 5-30 vol % $Mg(NO_3)_2$, about 5-30 vol % potassium and sodium phosphate and/or carboxylic acid acid buffer salts and optionally a thickener for about 12 cP (20° C.) and about 0.05 vol % chelating agent for the treatment of textile material in order to obtain a used look, a vintage look or a change in the color, optionally on preselected areas of the textile material.

A further embodiment of the invention relates to the use of an aqueous solution comprising about 50-30 vol % $K(NO_3)_2$, about 5-30 vol % potassium and sodium phosphate and/or carboxylic acid buffer salts and optionally a thickener for about 12 cP (20° C.) and about 0.05 vol % chelating agent for the treatment of textile material in order to obtain a used look, a vintage look or a change in the color, optionally on preselected areas of the textile material.

A further embodiment of the invention relates to the use of an aqueous solution comprising about 1-30 vol % $Li(NO_3)_2$, about 5-30 vol % potassium and sodium phosphate and/or carboxylic acid buffer salts and optionally a thickener for about 12 cP (20° C.) and about 0.05 vol % chelating agent for the treatment of textile material in order to obtain a used look, a vintage look or a change in the color, optionally on preselected areas of the textile material.

A further embodiment of the invention relates to the use of an aqueous solution comprising about 5-30 vol % $Na(NO_3)_2$, about 5-30 vol % potassium and sodium phosphate and/or carboxylic acid buffer salts and optionally a thickener for about 12 cP (20° C.) and about 0.05 vol % chelating agent for the treatment of textile material in order to obtain a used look, a vintage look or a change in the color, optionally on preselected areas of the textile material.

A further embodiment of the invention relates to the use of an aqueous solution comprising about 1-30 vol % $Ca(NO_3)_2$, about 5-30 vol % potassium and sodium phosphate and/or carboxylic acid buffer salts and optionally a thickener for about 12 cP (20° C.) and about 0.05 vol % chelating agent for the treatment of textile material in order to obtain a used look, a vintage look or a change in the color, optionally on preselected areas of the textile material.

A further embodiment of the invention relates to the use of an aqueous solution comprising about 0.1-30 vol % $Fe(NO_3)_2$, about 5-30 vol % potassium and sodium phosphate and/or carboxylic acid buffer salts and optionally a thickener for about 12 cP (20° C.) and about 0.05 vol % chelating agent for the treatment of textile material in order to obtain a used look, a vintage look or a change in the color, optionally on preselected areas of the textile material.

A further embodiment of the invention relates to the use of an aqueous solution comprising about 0.1-30 vol % $Cu(NO_3)_2$, about 5-30 vol % potassium and sodium phosphate and/or carboxylic acid buffer salts and optionally a thickener for about 12 cP (20° C.) and about 0.05 vol % chelating agent for the treatment of textile material in order to obtain a used look, a vintage look or a change in the color, optionally on preselected areas of the textile material.

A further embodiment of the invention relates to the use of an aqueous solution comprising about 0.001-250 vol % $Zn(NO_3)_2$, about 5-30 vol % potassium and sodium phosphate and/or carboxylic acid buffer salts and optionally a thickener for about 12 cP (20° C.) and about 0.05 vol % chelating agent for the treatment of textile material in order to obtain a used look, a vintage look or a change in the color, optionally on preselected areas of the textile material.

A further embodiment of the invention relates to the use of an aqueous solution comprising about 1-30 vol % $Co(NO_3)_2$, about 5-30 vol % potassium and sodium phosphate and/or carboxylic acid buffer salts and optionally a thickener for about 12 cP (20° C.) and about 0.05 vol % chelating agent for the treatment of textile material in order to obtain a used look, a vintage look or a change in the color, optionally on preselected areas of the textile material.

In a further embodiment the colour value changes and can be measured in a ΔL value of 2 between the untreated and treated part. L stands for the lightness in the CIE 1976 Lab color space (CIELAB color space, defined by the International Commission on Illumination (CIE) in 1976). A color value means the lightness or darkness of the color of the desired effect which can also be referred to as color intensity or the degree of whiteness or degree of brightness.

In a further embodiment isatin, anthranilic acid (2-aminobenzoic acid) and carbamic acid are formed due to the general oxidation reaction of indigo. Other reaction products are 5-nitroisatin, 5-nitrosalicylic acid and picric acid, which are formed due to the specific oxidation of indigo by the action of the nitrate compounds. These products may be analyzed e.g. by means of NMR, liquid chromatography or gas chromatography after appropriate sample preparation or derivatization, respectively, of the mentioned products.

In a further embodiment the anhydroglucose units of the denim material may be esterified on positions 2, 3 and/or 6 by action of the nitrate compounds under given conditions.

As stated above for activation no heating step is required for the bleaching process. According to the inventive process bleaching occurs after catalytic activation of the nitrate salt by the acid catalyst. However, applying a moderate heating step by a type of advection, conduction, convection or radiation, or a combination, may improve the intensity of the effect on various fabric and dyeing types and increase the speed of effect generation. Therefore the treatment may optionally be carrying out at a temperature of about 10-90° C., or of about 10-70° C., or of about 10-60° C., or of about 10-40° C., or of about 20-80° C., or of about 20-60° C., or of about 20-35° C.

Now there are a number of chemicals that could oxidize indigo to produce a bleached effect such as enzymes, hypochlorite, organo peroxides, zinc nitrate and potassium permanganate. However, these chemicals are hazardous and thus do not solve the industry problem.

It is also known in the prior art that the magnesium salt $Mg(NO_3)_2$ can generate compounds that oxidize the indigo dye in denim and produce bleached effects. The respective relevant chemical reaction is:

$$Mg(NO_3)_2 \rightarrow MgO + 2NO_2 + \tfrac{1}{2}O_2$$

The chemical reaction generates nitrogen oxides which attack or oxidize the Indigo dye at the denim. The $NO_2$ can be a variety of nitrogen oxide ($NO_x$) compounds, such as $N_2O$, $N_2O_3$, $NO_2$, $N_2O_4$, $NO_3$, $N_2O_4$, $N_2O_5$, $NO_3$, $N_2O_6$ and NO. $NO_x$ is hazardous by itself but it is either consumed by the indigo or evaporated and immediately exhausted with the laser fumes, so it is not hazardous to the workers. However, to promote the chemical reaction so as to achieve noticeable bleaching effects on denim, the magnesium salt is applied to denim and then the treated denim is heated at temperatures of about 140° C. for about 20 minutes. The activation energy to promote the chemical reaction is dependent upon both time and temperature. So applying a laser process to the denim treated with the magnesium salt will not generate the chemical reaction and thus will not produce a bleached effect even though the laser temperature is much higher than 140° C.

Laser systems are used in fashion design, pleating, cutting and modification of fabric surface to impart some special finish. Laser fading works with better precision and higher productivity but also have some drawbacks. The laser works by creating extensive heat. Within the focused region, the material is subject to very intensive heating within a very small region and time. Laser energy is absorbed as heat and the material rapidly heats leading to melting as a phase change from solid to liquid takes place.

Irradiation may be applied by a laser device that emits light through a process of optical amplification based on the stimulated emission of electromagnetic radiation.

Most lasers, for example Nd:YAG lasers, many fiber lasers and the most powerful laser diodes emit near-infrared light. There are comparatively few laser sources for the mid- and far-infrared spectral regions. $CO_2$ lasers can emit at 10.6 μm and some other wavelengths in that region.

The technology of lasers for the generation of ultraviolet light faces various challenges; nevertheless, there are a few kinds of ultraviolet lasers which can directly generate UV light: some bulk lasers (e.g. based on cerium-doped crystals such as Ce:LiCAF), fiber lasers, laser diodes (mostly GaN-based), dye lasers, excimer lasers, and free electron lasers.

According to one embodiment of the invention the pretreated textile material is placed under a laser device and then scanning a laser beam having a selected wavelength, power density, pulse width, and repetition rate over the textile material until the desired degree of fading and/or worn appearance or the selected pattern is achieved.

The laser may be a q-switched Nd:YAG laser with a wavelength of about 1064 nanometers, although other lasers, such as $CO_2$ gas lasers or excimer gas lasers may be utilized. The wavelength of the laser is chosen to give optimal dye photo-decomposition without affecting the textile material.

The scanning of the laser beam over the textile material may be controlled by galvanometric mirror, acousto-optic deflector, deflector, magneto-optic beam deflector, polygon mirror, or a moving holographic optical element.

Other possible wavelengths for other laser sources range between 190 nanometers to 10600 nanometers. An excimer laser may operate effectively at wavelengths of 196 nm to 235 nm, or a $CO_2$ laser may operate effectively at 10600 nanometers. The wavelength of the laser should be chosen such that it is strongly absorbed by the dye to be faded but not by the textile material. The range of pulse duration used has been from 5 nanoseconds to 100 microseconds, with the best results being from 20 to 350 nanoseconds. Other variables, such as the pulse energy, peak power, scan speed, dot pitch, and energy density play an important factor in the degree of photo-decomposition and the avoidance of damage to the textile material.

For example, these variable parameters may include the laser beam having a repetition rate from 1 hertz to 500 MHz ($500\times10^6$ hertz), a pulse duration between approximately 10 fs ($10\times10^{-15}$ seconds) to 500 ms ($500\times10^{-3}$ seconds), the laser beam may have a continuous output beam and is classified as a cw laser, a pulsed laser, or the laser beam have a scan speed of 1 mm per minute to 500 meter/second, and a dot pitch between 0.1 um to 5 meters.

Additionally further textile auxiliary chemicals may be added in any combination and concentration in solid or liquid form to improve the usability and performance of the product according to what is required: e.g. dispersants, wetting agents, surfactants, softener, thickening agents, plastics, colorants, tinting agents, silicones, levelling agents, antifoams, antimigration agents, antibackstaining agents, softeners, stabilizers and optical brightening agents. These additives are well known to experts in the field and can be chosen according to commonly used concentrations depending on the desired effect, e.g. 0.001-10 vol %. Colorants may be selected from but not limited to dispersing dyes, acid dyes, basic dyes, vat dyes, Sulphur dyes, azoic dyes like methylene red and others. Food dyes like Fast Green FCF, Erythrosine, Tartrazine, Sunset Yellow FCF, Citrus Red 2, Orange B, Quinoline Yellow, Carmoisine, Ponceau 4R, Patent Blue V, Green S, Allurared AC, Amaranth, anthocyanins, Azorubin, Betanin, Brown FK, Brown HT, Brilliant blue, Brilliant black, Canthaxanthin, Carotin, carotene, Annatto (Norbixin), Capsanthin, lycopene, 8'-Apo-β-caroten-8'-al, Ethyl-8'-apo-β-caroten-8'-oat, Chinolin yellow, Chlorophyll, Cochenille red A, Curcumin, Iron oxide, erythrosine, Yellow orange, Gold, Green S, Indigotin, Cochenille, Lactoflavin, Litholrubin BK, Lutein, Patent Blue V, Riboflavin, Silver, tartrazine, Titanium dioxide, Zeaxanthin, as well as duramine (e.g. Red), chromene (e.g. Red, Blue, Yellow), Evron Red may also be used. Other auxiliaries or their ingredients may be selected from but not limited to Tween 20, butyl diglycol, sodium dodecyl sulate, sodium olefin sulfonate, sodium laureth sulfate, sodium lauryl ether sulfate, alanine-N,N-diacetic acid trisodium salt, glutamine-N,N-diacetic acid trisodium salt, DMSO and sulfolane. Respective softeners are fatty alcohol polyglycol ether, acrylic acid, 3,5,7-trimethyldecane, soap, triglycerides, polydimethylsiloxane, cyclopentasiloxane, emulsifiers, lignosulfonate, cationic surfactants, anionic surfactants, esterquats, ionic liquids, sodium 2-ethylhexyl sulfate, 2-methyl-2,4-pentanediol, tributyl phosphate, triisobutyl phosphate, 1-hydroxyethane-1,1,-diphosphonic acid (HEDP), 2,2-dimethyl-1,3-propanediol. Oxidizers as respective additives could be peroxides, peroxy acids and/or persulfates. Thickening agents may be selected from but not limited to products which are commonly used in textile auxiliaries, food additives, cosmetics and personal hygiene products, i.e. starch and modified starches, cellulose and modified cellulose (i.e. methyl cellulose, ethyl cellulose, hydroxyethyl cellulose, carboxymethyl cellulose, hydroxypropylmethyl cellulose, hydroxypropyl cellulose, ethylhydroxyethyl cellulose), alginates (i.e. sodium-, potassium-, ammonium-, propylenglycol alginate), gum arabic, carrageen, agar-agar, Ceratonia silique, guar gum, Traganth, gellan, pectin, gelatin. Other chemicals may be added to impart more desirable improvement of the substrate in hand feel or other properties like softness, waterproofing, antimicrobial or microbe reducing chemicals, encapsulated perfumes, etc., or co-solvents (alcohols, ketones, nonionic solvents, ionic solvents, ionic liquids, etc.).

EXAMPLES

The Examples which follow are set forth to aid in the understanding of the invention but are not intended to, and should not be construed to limit the scope of the invention in any way. The Examples do not include detailed descriptions of conventional methods. Such methods are well known to those of ordinary skill in the art.

A denim fabric was subjected to a singeing treatment, a skewing treatment and a preshrinking treatment. Then, an aqueous solution comprising an acid and a nitrate salt was applied to the surface.

A denim fabric was subjected to a singeing treatment, a skewing treatment, a preshrinking treatment and a desizing treatment. Then, a thickened aqueous solution comprising an acid and a nitrate salt was applied to the surface by printing.

A denim fabric was subjected to a singeing treatment, a skewing treatment, a preshrinking treatment and a desizing treatment. Then, an aqueous solution comprising an acid compound was applied by immersion and dried. The treated fabric is sewed to a garment and a nitrate containing solution is applied by spray to the garment.

A denim fabric was subjected to a singeing treatment, a skewing treatment, a preshrinking treatment and a desizing treatment. Then, an aqueous solution comprising an acid compound is applied to the surface by kiss-roll and dried. The treated fabric is sewed to a garment and a nitrate containing solution is applied by spray to the garment.

A denim fabric was subjected to a singeing treatment, a skewing treatment, a preshrinking treatment and a desizing treatment. Then, an aqueous solution comprising a nitrate salt is applied by immersion and dried. The treated fabric is sewed to a garment and an acid compound containing solution is applied by spray to the garment.

The color changing effect in such pretreated denim fabrics is then generated with or without heat treatment (including microwave irradiation, IR irradiation, etc.) depending on the composition of the solution.

A denim fabric was subjected to a singeing treatment, a skewing treatment and a preshrinking treatment. Then, an aqueous solution comprising an acid and a nitrate salt is applied by immersing or only to the surface (e.g. kiss roll, knife application, foaming, etc.). The effect is generated during a subsequent heat treatment.

A denim fabric was subjected to a singeing treatment, a skewing treatment, a preshrinking treatment, an ozone treatment and/or a laser treatment. Then, an aqueous solution comprising an acid and a nitrate salt is applied by immersion or only to the surface (e.g. kiss roll, knife application, foaming, etc.). The effect is generated during a subsequent heat treatment.

A denim yarn is immersed in a solution comprising the acid and the nitrate. Subsequently the yarn is sized and woven to a fabric. The effect is generated during a subsequent heat treatment.

A solution comprising the acid and the nitrate is applied to denim yarn by a kiss roll, foaming or spray. Subsequently the yarn is sized and woven to a fabric. The effect is generated during a subsequent heat treatment.

A raw denim garment was abraded by laser or hand sanding to mark specific used look areas. Subsequently a solution containing nitrate and acid is sprayed or applied by brush or sponge on the abraded areas.

A raw denim garment was desized and dried. Subsequently a solution containing nitrate and acid is sprayed or applied by brush or sponge on the abraded areas.

A raw denim garment is used as it is, or desized, and/or stonewashed, and or ozone treated, and/or enzyme washed and dried. Subsequently a solution containing nitrate and acid is sprayed or applied by brush or sponge on specific areas of the garment.

A raw denim garment is used as it is, or desized, and/or stonewashed, and/or ozone treated, and/or enzyme washed and dried. Subsequently a solution containing a nitrate is applied to the garment and dried. Subsequently a solution containing an acid is applied by brush or sponge on specific areas of the garment.

A raw denim garment is used as it is, or desized, and/or stonewashed or enzyme washed and dried. Subsequently a solution containing an acid is applied to the garment and dried. Subsequently a solution containing a nitrate is applied by brush or sponge on specific areas of the garment.

Pumice stones are soaked in a solution containing an acid and a nitrate and subsequently agitated with a denim garment in a tumbler.

A denim garment is wetted and placed together with a powder containing nitrate and acid (if needed together with a filler material like sand, perlite, etc.) in a bag and agitated until the effect is created.

The color changing effect in such pretreated denim fabrics is then generated with or without applying any heat treatment.

A solution containing nitrate salt and an acid catalyst acid is applied to a fabric or denim garment and subjected to microwave irradiation. The power of irradiation varies from 100 W to 1000 W, depending on the desired effect. The time of irradiation varies from 10 second to 1200 seconds, also depending on the desired effect.

A solution containing nitrate salt and an acid catalyst is applied to a fabric or denim garment and subjected to microwave irradiation.

Fabrics treated according to the preceding paragraphs are subsequently rinsed with water, washed under acidic conditions (e.g. pH<5) and/or basic conditions (e.g. pH>10) at cold and/or warm conditions (e.g. 30-90° C.) and a combination thereof.

These fabrics are subsequently washed with methods known to the skilled person of the art, e.g. chlorine treatment, hydrogen peroxide treatment, potassium peroxide treatment, ozone treatment, enzyme (cellulose, laccase, peroxidase, etc.) treatment, stonewashing, glucose treatment, organo peroxide treatment, softening, tinting (adjusting the colour tone with dyestuffs), etc.

The fabrics of the foregoing examples are previously washed with methods known to the skilled person of the art, e.g. chlorine treatment, hydrogen peroxide treatment, potassium peroxide treatment, ozone treatment, enzyme (cellulose, laccase, peroxidase, etc.) treatment, stonewashing, glucose treatment, organo peroxide treatment, scraping, lasering, ice-blasting, carbon dioxide blasting, sand blasting, etc.

Tables 1 to 7 depict compositions of aqueous solutions which are applied to denim fabrics.

Table 8 depicts examples of microwave irradiation as respective heating/activation step.

TABLE 1

| # | Nitrate Salt | [%] | Acid Catalyst | [%] | Acid | [%] | Time [h] |
|---|---|---|---|---|---|---|---|
| 1 | $Mg(NO_3)_2 \cdot 6H_2O$ | 51.0 | $MgSO_4$ | 5.7 | methane-sulfonic acid | 10.0 | 0.5 |
| 2 | $Mg(NO_3)_2 \cdot 6H_2O$ | 51.0 | $Ce(SO_4)_2$ | 1.0 | methane-sulfonic acid | 10.0 | 0.5 |

TABLE 1-continued

| # | Nitrate Salt | [%] | Acid Catalyst | [%] | Acid | [%] | Time [h] |
|---|---|---|---|---|---|---|---|
| 3 | $Mg(NO_3)_2 \cdot 6H_2O$ | 51.0 | $VOSO_4$ | 4.2 | methane-sulfonic acid | 10.0 | 0.5 |
| 4 | $Mg(NO_3)_2 \cdot 6H_2O$ | 51.0 | $FeSO_4$ | 1.6 | methane-sulfonic acid | 10.0 | 0.5 |
| 5 | $Mg(NO_3)_2 \cdot 6H_2O$ | 51.0 | $Fe_2(SO_4)_3$ | 6.5 | methane-sulfonic acid | 10.0 | 0.5 |
| 6 | $Mg(NO_3)_2 \cdot 6H_2O$ | 52.0 | | | citric acid | 30.0 | 4 |
| 7 | $Mg(NO_3)_2 \cdot 6H_2O$ | 34.8 | | | tartaric acid | 40.0 | 2 |
| 8 | $Mg(NO_3)_2 \cdot 6H_2O$ | 55.1 | | | oxalic acid | 5.0 | 0.5 |
| 9 | $Mg(NO_3)_2 \cdot 6H_2O$ | 51.0 | | | methane-sulfonic acid | 10.0 | 0.5 |
| 10 | $Mg(NO_3)_2 \cdot 6H_2O$ | 51.0 | | | nitric acid | 6.5 | 0.5 |
| 11 | $Mg(NO_3)_2 \cdot 6H_2O$ | 51.0 | | | methane-sulfonic acid | 10.0 | 0.5 |
| 12 | $Mg(NO_3)_2 \cdot 6H_2O$ | 51.0 | | | HCl 25% | 10.0 | 0.5 |
| 13 | $Mg(NO_3)_2 \cdot 6H_2O$ | 51.0 | $ZnCl_2$ | 3.3 | methane-sulfonic acid | 10.0 | 0.5 |
| 14 | $Mg(NO_3)_2 \cdot 6H_2O$ | 51.0 | $FeCl_3$ 90% | 9.7 | methane-sulfonic acid | 10.0 | 0.5 |
| 15 | $Mg(NO_3)_2 \cdot 6H_2O$ | 51.0 | $CuCl_2$ | 4.1 | methane-sulfonic acid | 10.0 | 0.5 |
| 16 | $Mg(NO_3)_2 \cdot 6H_2O$ | 51.0 | $FeCl_2$ | 4.8 | methane-sulfonic acid | 10.0 | 0.5 |
| 17 | $Mg(NO_3)_2 \cdot 6H_2O$ | 51.0 | $AlCl_3$ | 3.2 | methane-sulfonic acid | 10.0 | 0.5 |
| 18 | $Mg(NO_3)_2 \cdot 6H_2O$<br>$LiNO_3$ | 40.0<br>2.0 | | | maleic acid | 16.0 | 1 |
| 19 | $Mg(NO_3)_2 \cdot 6H_2O$<br>$LiNO_3$ | 57.0<br>2.9 | | | $H_2SO_4$ | 5.0 | 0.5 |
| 20 | $Mg(NO_3)_2 \cdot 6H_2O$<br>$LiNO_3$ | 51.0<br>2.6 | | | HCl 25% | 15.0 | 0.5 |
| 21 | $Mg(NO_3)_2 \cdot 6H_2O$<br>$LiNO_3$ | 30.0<br>1.5 | | | tartaric acid | 30.0 | 3 |
| 22 | $Mg(NO_3)_2 \cdot 6H_2O$<br>$LiNO_3$ | 60.0<br>3.0 | | | $H_2SO_4$ 98% | 1.0 | 0.5 |
| 23 | $LiNO_3$ | 27.9 | | | methane-sulfonic acid | 10.0 | 0.5 |
| 24 | $Al(NO_3)_3$ | 50.5 | | | methane-sulfonic acid | 10.0 | 0.5 |
| 25 | $Ca(NO_3)_2$ | 47.7 | | | methane-sulfonic acid | 10.0 | 0.5 |
| 26 | $Fe(NO_3)_3 \cdot 9H_2O$ | 54.0 | | | methane-sulfonic acid | 10.0 | 0.5 |
| 27 | $Cu(NO_3)_2$ | 48.0 | | | methane-sulfonic acid | 10.0 | 0.5 |
| 28 | $Zn(NO_3)_2$ | 60.0 | | | methane-sulfonic acid | 10.0 | 0.5 |
| 29 | $KNO_3$ | 40.0 | | | methane-sulfonic acid | 10.0 | 0.5 |
| 30 | $LiNO_3$ | 13.9 | | | methane-sulfonic acid | 10.0 | 0.5 |
| 31 | $KNO_3$ | 20.0 | | | methane-sulfonic acid | 10.0 | 0.5 |
| 32 | $Fe(NO_3)_3 \cdot 9H_2O$ | 40.0 | | | methane-sulfonic acid | 10.0 | 0.5 |

TABLE 1-continued

| # | Nitrate Salt | [%] | Acid Catalyst | [%] | Acid | [%] | Time [h] |
|---|---|---|---|---|---|---|---|
| 33 | $(NH_4)_2Ce(NO_3)_6$ | 36.0 | | | methane-sulfonic acid | 10.0 | 0.5 |
| 34 | $Co(NO_3)_2 \cdot 6H_2O$ | 58.0 | | | methane-sulfonic acid | 10.0 | 0.5 |
| 35 | $Al(NO_3)_3 \cdot 9H_2O$ | 30.0 | | | citric acid | 25.0 | 4 |
| 36 | $Mg(NO_3)_2 \cdot 6H_2O$ | 63.0 | | | methane-sulfonic acid | 10.0 | 0.3 |

TABLE 2

| # | $Mg(NO_3)_2 \cdot 6H_2O$ [%] | +Nitrate Salt [%] | Acid Catalyst [%] | Acid [%] | Additive [%] | Thickener [%] | Temp [° C.] | Time [min] |
|---|---|---|---|---|---|---|---|---|
| 37 | 25 | $Al(NO_3)_3 \cdot 9H_2O$ 5 | | | | xanthan gum 0.3 | 50 | 20 |
| 38 | 25 | $Al(NO_3)_3 \cdot 9H_2O$ 4 | | | | xanthan gum 0.3 | 50 | 20 |
| 39 | 25 | $Al(NO_3)_3 \cdot 9H_2O$ 3 | | | | xanthan gum 0.3 | 50 | 20 |
| 40 | 25 | $Al(NO_3)_3 \cdot 9H_2O$ 2 | | | | xanthan gum 0.3 | 50 | 20 |
| 41 | 25 | $Al(NO_3)_3 \cdot 9H_2O$ 1 | | | | xanthan gum 0.3 | 50 | 20 |
| 42 | 25 | $Al(NO_3)_3 \cdot 9H_2O$ 0.1 | | tartaric acid 1 | | | 60 | 20 |
| 43 | 25 | $Al(NO_3)_3 \cdot 9H_2O$ 45 | | | | | 80 | 20 |
| 44 | | $Al(NO_3)_3 \cdot 9H_2O$ 40 | | | | | 80 | 20 |
| 45 | | $Al(NO_3)_3 \cdot 9H_2O$ 35 | | | | | 80 | 20 |
| 46 | | $Al(NO_3)_3 \cdot 9H_2O$ 30 | | | | | 80 | 20 |
| 47 | | $Al(NO_3)_3 \cdot 9H_2O$ 25 | | | | | 80 | 20 |
| 48 | | $Al(NO_3)_3 \cdot 9H_2O$ 20 | | | | | 80 | 20 |
| 49 | | $Al(NO_3)_3 \cdot 9H_2O$ 18 | | | | | 80 | 20 |
| 50 | 70 | | $CaCl_2$ 2 | | | | 20 | 20 |
| 51 | 70 | | $ZnCl_2$ 2 | | | | 20 | 20 |
| 52 | 70 | | NaCl 2 | | | | 20 | 20 |
| 53 | 70 | | KCl 2 | | | | 20 | 20 |
| 54 | 70 | | LiCl 2 | | | | 20 | 20 |
| 55 | 70 | | $SrCl_2$ 2 | | | | 20 | 20 |
| 56 | 70 | | $MgCl_2$ 2 | | | | 20 | 20 |
| 57 | 70 | | $(NH_4)_2SO_4$ 2 | | | | 20 | 20 |
| 58 | 70 | | $CuSO_4$ 2 | | | | 20 | 20 |
| 59 | 70 | | $Li_2SO_4$ 2 | | | | 20 | 20 |
| 60 | 70 | | $NH_4Al(SO_4)_2$ 2 | | | | 20 | 20 |
| 61 | 70 | | $KAl(SO_4)_2$ 2 | | | | 20 | 20 |
| 62 | 70 | | $FeSO_4$ 2 | | | | 20 | 20 |
| 63 | | | $Ce(SO_4)_2$ 2 | | | | 20 | 20 |
| 64 | 20 | $Al(NO_3)_3 \cdot 9H_2O$ 4 | | | $Zn(NO_3)_2 \cdot 6H_2O$ 0.05 | xanthan gum 0.15 | 60 | 20 |
| 65 | 25 | $Fe(NO_3)_2 \cdot 6H_2O$ 1 | | tartaric acid 4 | | | 80 | 10 |
| 66 | 30 | $Fe(NO_3)_2 \cdot 6H_2O$ 0.01 | | tartaric acid 1 | | | 80 | 20 |
| 67 | | $LiNO_3$ 30 | | | | | 80 | 20 |
| 68 | 35 | | $CaCl_2$ 2 | citric acid 10 | | | 60 | 20 |
| 69 | 35 | | $ZnCl_2$ 2 | citric acid 10 | | | 60 | 20 |
| 70 | 35 | | NaCl 2 | citric acid 10 | | | 60 | 20 |
| 71 | 35 | | KCl 2 | citric acid 10 | | | 60 | 20 |
| 72 | 35 | | LiCl 2 | citric acid 10 | | | 60 | 20 |
| 73 | 35 | | $SrCl_2$ 2 | citric acid 10 | | | 60 | 20 |
| 74 | 35 | | $MgCl_2$ 2 | citric acid 10 | | | 60 | 20 |
| 75 | 35 | | $(NH_4)_2SO_4$ 2 | citric acid 10 | | | 60 | 20 |
| 76 | 35 | | $CuSO_4$ 2 | citric acid 10 | | | 60 | 20 |
| 77 | 35 | | $Li_2SO_4$ 2 | citric acid 10 | | | 60 | 20 |
| 78 | 35 | | $NH_4Al(SO_4)_2$ 2 | citric acid 10 | | | 60 | 20 |
| 79 | 35 | | $KAl(SO_4)_2$ 2 | citric acid 10 | | | 60 | 20 |
| 80 | 35 | | $FeSO_4$ 2 | citric acid 10 | | | 60 | 20 |
| 81 | 35 | | $Ce(SO_4)_2$ 2 | citric acid 10 | | | 60 | 20 |
| 82 | 35 | | $CaCl_2$ 2 | tartaric acid 4 | | | 60 | 20 |
| 83 | 35 | | $ZnCl_2$ 2 | tartaric acid 4 | | | 60 | 20 |
| 84 | 35 | | NaCl 2 | tartaric acid 4 | | | 60 | 20 |
| 85 | 35 | | KCl 2 | tartaric acid 4 | | | 60 | 20 |
| 86 | 35 | | LiCl 2 | tartaric acid 4 | | | 60 | 20 |
| 87 | 35 | | $SrCl_2$ 2 | tartaric acid 4 | | | 60 | 20 |
| 88 | 35 | | $MgCl_2$ 2 | tartaric acid 4 | | | 60 | 20 |
| 89 | 35 | | $(NH_4)_2SO_4$ 2 | tartaric acid 4 | | | 60 | 20 |
| 90 | 35 | | $CuSO_4$ 2 | tartaric acid 4 | | | 60 | 20 |
| 91 | 35 | | $Li_2SO_4$ 2 | tartaric acid 4 | | | 60 | 20 |
| 92 | 35 | | $NH_4Al(SO_4)_2$ 2 | tartaric acid 4 | | | 60 | 20 |
| 93 | 35 | | $KAl(SO_4)_2$ 2 | tartaric acid 4 | | | 60 | 20 |
| 94 | 35 | | $FeSO_4$ 2 | tartaric acid 4 | | | 60 | 20 |
| 95 | 35 | | $Ce(SO_4)_2$ 2 | tartaric acid 4 | | | 60 | 20 |
| 96 | 25 | | | tartaric acid 5 | $Zn(NO_3)_2 \cdot 6H_2O$ 0.09 | | 60 | 20 |

TABLE 3

| # | $Mg(NO_3)_2*6H_2O$ [%] | +Nitrate Salt | [%] | Acid | [%] | Addition | [%] | Thickener | [%] | Temp [° C.] | Time [min] |
|---|---|---|---|---|---|---|---|---|---|---|---|
| 97 | 26.6 | $Zn(NO_3)_2*6H_2O$ | 0.05 | tartaric acid | 2 | | | | | 60 | 20 |
| 98 | 26.6 | $Zn(NO_3)_2*6H_2O$ | 0.05 | malonic acid | 2 | | | | | 60 | 20 |
| 99 | 26.6 | $Zn(NO_3)_2*6H_2O$ | 0.05 | citric acid | 2 | | | | | 60 | 20 |
| 100 | 26.6 | $Zn(NO_3)_2*6H_2O$ | 0.05 | maleic acid | 2 | | | | | 60 | 20 |
| 101 | 26.6 | $Zn(NO_3)_2*6H_2O$ | 0.05 | methanesulfonic acid | 5 | | | | | 60 | 20 |
| 102 | 26.6 | $Zn(NO_3)_2*6H_2O$ | 0.05 | methanesulfonic acid | 10 | | | | | 60 | 20 |
| 103 | 26.6 | $Zn(NO_3)_2*6H_2O$ | 0.05 | tartaric acid | 2 | DMSO | 1 | | | 60 | 20 |
| 104 | 26.6 | $Zn(NO_3)_2*6H_2O$ | 0.05 | tartaric acid | 2 | $LiNO_3$ | 1 | | | 60 | 20 |
| 105 | 26.6 | $Zn(NO_3)_2*6H_2O$ | 0.05 | tartaric acid | 2 | triethanolamine | 5 | | | 60 | 20 |

TABLE 4

| # | $Mg(NO_3)_2*6H_2O$ [%] | Acid Catalyst | [%] | Acid | [%] | Temp [° C.] | Time [min] |
|---|---|---|---|---|---|---|---|
| 106 | 35 | $KAl(SO_4)_2•12H_2O$<br>LiCl | 5<br>2.5 | tartaric acid | 2 | 60 | 20 |
| 107 | 35 | $KAl(SO_4)_2•12H_2O$<br>LiCl | 5<br>1 | tartaric acid | 2 | 60 | 20 |
| 108 | 35 | $KAl(SO_4)_2•12H_2O$<br>LiCl | 5<br>0.5 | tartaric acid | 2 | 60 | 20 |
| 109 | 35 | $KAl(SO_4)_2•12H_2O$<br>LiCl | 5<br>0.1 | tartaric acid | 2 | 60 | 20 |
| 110 | 35 | $KAl(SO_4)_2•12H_2O$ | 5 | malonic acid | 2 | 60 | 20 |
| 111 | 35 | $KAl(SO_4)_2•12H_2O$ | 5 | citric acid | 2 | 60 | 20 |
| 112 | 35 | $KAl(SO_4)_2•12H_2O$ | 5 | maleic acid | 2 | 60 | 20 |
| 113 | 35 | $KAl(SO_4)_2•12H_2O$ | 5 | lactic acid | 2 | 60 | 20 |
| 114 | 35 | $KAl(SO_4)_2•12H_2O$ | 5 | oxalic acid | 2 | 60 | 20 |

TABLE 5

| # | $Mg(NO_3)_2•6H_2O$ [%] | Acid Catalyst | [+] | Acid | [%] | Additive | [%] | Temp [° C.] | Time [min] |
|---|---|---|---|---|---|---|---|---|---|
| 115 | 35 | $KAl(SO_4)_2•12H_2O$ | 5 | acetic acid | 2 | | | 60 | 20 |
| 116 | 35 | $KAl(SO_4)_2•12H_2O$ | 5 | phosphoric acid | 1 | | | 60 | 20 |
| 117 | 70 | $KAl(SO_4)_2•12H_2O$ | 5 | hydrochloric acid | 3.6 | | | 60 | 20 |
| 118 | 35 | $KAl(SO_4)_2•12H_2O$ | 5 | sulphuric acid | 4.5 | | | 60 | 20 |
| 119 | 35 | $KAl(SO_4)_2•12H_2O$ | 5 | salpetric acid | 1.5 | | | 60 | 20 |
| 120 | 35 | $KAl(SO_4)_2•12H_2O$ | 5 | tartaric acid | 2 | Dispersoko ICP 100 CO | 0.01 | 60 | 20 |
| 121 | 35 | $KAl(SO_4)_2•12H_2O$ | 5 | tartaric acid | 2 | Dispersoko ICP 100 PL | 0.01 | 60 | 20 |
| 122 | 35 | $KAl(SO_4)_2•12H_2O$ | 5 | tartaric acid | 2 | polysorbate 20 | 0.1 | 60 | 20 |
| 123 | 35 | $KAl(SO_4)_2•12H_2O$ | 5 | tartaric acid | 2 | Nofome AF | 0.1 | 60 | 20 |

TABLE 6

| # | $Mg(NO_3)_2•6H_2O$ [%] | Nitrate Salt | [%] | Acid Catalyst | [%] | Acid | [%] | Additive | [%] | Temp [° C.] | Time [min] |
|---|---|---|---|---|---|---|---|---|---|---|---|
| 124 | 35 | | | $KAl(SO_4)_2•12H_2O$ | 5 | tartaric acid | 2 | Setamol Disperse WS | 0.1 | 60 | 20 |
| 125 | 26.6 | $Zn(NO_3)_2•6H_2O$ | 0.05 | | | tartaric acid | 2 | Methyl red | 0.01 | 60 | 20 |
| 126 | 26.6 | $Zn(NO_3)_2•6H_2O$ | 0.05 | | | tartaric acid | 2 | Chromene Red | 0.005 | 60 | 20 |
| 127 | 26.6 | $Zn(NO_3)_2•6H_2O$ | 0.05 | | | tartaric acid | 2 | Chromene Red | 0.01 | 60 | 20 |
| 128 | 26.6 | $Zn(NO_3)_2•6H_2O$ | 0.05 | | | tartaric acid | 2 | Chromene Red | 0.015 | 60 | 20 |
| 129 | 26.6 | $Zn(NO_3)_2•6H_2O$ | 0.05 | | | tartaric acid | 2 | Chromene Red | 0.02 | 60 | 20 |

TABLE 6-continued

| # | $Mg(NO_3)_2 \cdot 6H_2O$ [%] | Nitrate Salt | [%] | Acid Catalyst | [%] | Acid | [%] | Additive | [%] | Temp [° C.] | Time [min] |
|---|---|---|---|---|---|---|---|---|---|---|---|
| 130 | 26.6 | $Zn(NO_3)_2 \cdot 6H_2O$ | 0.05 | | | tartaric acid | 2 | Chromene Red | 0.025 | 60 | 20 |
| 131 | 35 | | | $KAl(SO_4)_2 \cdot 12H_2O$ | 5 | tartaric acid | 2 | Methyl red | 0.01 | 60 | 20 |
| 132 | 35 | | | $KAl(SO_4)_2 \cdot 12H_2O$ | 5 | tartaric acid | 2 | Chromene Red | 0.005 | 60 | 20 |
| 133 | 35 | | | $KAl(SO_4)_2 \cdot 12H_2O$ | 5 | tartaric acid | 2 | Chromene Red | 0.01 | 60 | 20 |

TABLE 7

| # | $Mg(NO_3)_2 \cdot 6H_2O$ [%] | Acid Catalyst/ Nitrate Salt | [%] | Acid | [%] | Additive | [%] | Thickener | [%] | Temp [° C.] | Time [min] |
|---|---|---|---|---|---|---|---|---|---|---|---|
| 134 | 35 | $KAl(SO_4)_2 \cdot 12H_2O$ | 5 | tartaric acid | 2 | Chromene Red | 0.015 | | | 60 | 20 |
| 135 | 35 | $KAl(SO_4)_2 \cdot 12H_2O$ | 5 | tartaric acid | 2 | Chromene Red | 0.02 | | | 60 | 20 |
| 136 | 35 | $KAl(SO_4)_2 \cdot 12H_2O$ | 5 | tartaric acid | 2 | Chromene Red | 0.025 | | | 60 | 20 |
| 137 | 35 | | | | | monosodium phosphate | 2 | | | 60 | 20 |
| 138 | 35 | | | | | monosodium phosphate | 5 | | | 60 | 20 |
| 139 | 35 | | | | | monopotassium phosphate | 2 | | | 60 | 20 |
| 140 | 35 | | | | | monopotassium phosphate | 5 | | | 60 | 20 |
| 141 | 35 | | | | | | | | | 60 | 20 |
| 142 | 35 | | | | | disodium pyrophosphate | 5 | | | 60 | 20 |
| 143 | 25 | | | | | disodium pyrophosphate | 5 | | | 60 | 20 |
| 144 | 20 | | | | | disodium pyrophosphate | 5 | | | 60 | 20 |
| 145 | 15 | | | | | disodium pyrophosphate | 5 | | | 60 | 20 |
| 146 | 35 | | | | | disodium pyrophosphate | 5 | | | 45 | 20 |
| 147 | 20 | | | | | disodium pyrophosphate | 5 | | | 45 | 20 |
| 148 | 35 | | | tartaric acid | 1 | Tetranatrium-diphosphat | 1.5 | | | 60 | 20 |
| 149 | 26.6 | $Zn(NO_3)_2 \cdot 6H_2O$ | 0.05 | tartaric acid | 2 | Trilon M | 0.01 | | | 60 | 20 |
| 150 | 26.6 | $Zn(NO_3)_2 \cdot 6H_2O$ | 0.05 | tartaric acid | 2 | Dissolvine GL 38 | 0.01 | | | 60 | 20 |

TABLE 8

| # | Time [sec] | Power [W] |
|---|---|---|
| 151 | 10 | 1000 |
| 152 | 20 | 1000 |
| 153 | 30 | 1000 |
| 154 | 20 | 800 |
| 155 | 30 | 800 |
| 156 | 40 | 800 |
| 157 | 30 | 600 |
| 158 | 40 | 600 |
| 159 | 60 | 400 |
| 160 | 80 | 400 |
| 161 | 60 | 500 |
| 162 | 90 | 500 |
| 163 | 60 | 300 |
| 164 | 90 | 300 |
| 165 | 90 | 200 |
| 166 | 120 | 200 |

A denim fabric was subjected to a method as described in the examples above. The color changing effect in such pretreated denim fabrics is then generated with irradiation, e.g. by a laser treatment (e.g. as disclosed in US2016263928, US2016060807, US2015343568, US2015298253, US2015121965, and US2012263904).

A denim fabric was subjected to a singeing treatment, a skewing treatment and a preshrinking treatment. Then, an aqueous solution comprising an acid and/or a substance that can release an acid or initiate radicalic reactions and a nitrate compound is applied by immersing or only to the surface (e.g. kiss roll, knife application, foaming, etc.). The effect is generated during a subsequent laser treatment.

A denim fabric was subjected to a singeing treatment, a skewing treatment, a preshrinking treatment, an ozone treatment and/or a laser treatment. Then, an aqueous solution comprising an acid and/or a substance that can release an acid or initiate radicalic reactions and a nitrate compound is applied by immersion or only to the surface (e.g. kiss roll, knife application, foaming, etc.). The effect is generated during a subsequent laser treatment.

A denim yarn is immersed in a solution comprising the acid and/or a substance that can release an acid or initiate radicalic reactions and the nitrate. Subsequently the yarn is sized and woven to a fabric. The effect is generated during a subsequent laser treatment.

A solution comprising the acid and/or a substance that can release an acid or initiate radicalic reactions and the nitrate is applied to denim yarn by a kiss roll, foaming or spray. Subsequently the yarn is sized and woven to a fabric. The effect is generated during a subsequent laser treatment.

A raw denim garment was abraded by laser or hand sanding to mark specific used look areas. Subsequently a solution containing nitrate and acid and/or a substance that can release an acid or initiate radicalic reactions is sprayed or applied by brush or sponge on the abraded areas.

A raw denim garment was desized and dried. Subsequently a solution containing nitrate and acid and/or a substance that can release an acid or initiate radicalic reactions is sprayed or applied by brush or sponge on the abraded areas.

A raw denim garment is used as it is, or desized, and/or stonewashed, and or ozone treated, and/or enzyme washed and dried. Subsequently a solution containing nitrate and acid and/or a substance that can release an acid or initiate radicalic reactions is sprayed or applied by brush or sponge on specific areas of the garment.

A raw denim garment is used as it is, or desized, and/or stonewashed, and/or ozone treated, and/or enzyme washed and dried. Subsequently a solution containing a nitrate salt is applied to the garment and dried. Subsequently a solution containing an acid catalyst and/or a substance that can release an acid or initiate radicalic reactions is applied by brush or sponge on specific areas of the garment.

A raw denim garment is used as it is, or desized, and/or stonewashed or enzyme washed and dried. Subsequently a solution containing an acid catalyst and/or a substance that can release an acid or initiate radicalic reactions is applied to the garment and dried. Subsequently a solution containing a nitrate salt is applied by brush or sponge on specific areas of the garment.

Pumice stones are soaked in a solution containing an acid and/or a substance that can release an acid or initiate radicalic reactions and a nitrate salt and subsequently agitated with a denim garment in a tumbler.

A denim garment is wetted and placed together with a powder containing nitrate salt and acid catalyst and/or a substance that can release an acid or initiate radicalic reactions (if needed together with a filler material like sand, perlite, etc.) in a bag and agitated until the effect is created.

A ring or surface dyed yarn is used. A solution containing nitrate and acid and/or a substance that can release an acid or initiate radicalic reactions is applied to the yarn, (e.g. by means of padding, coating, foaming, printing, etc.). Subsequently the yarn is subjected to sizing treatment and further processing for fabric and garment production.

A ring or surface dyed yarn which is sized is used. A solution containing nitrate and acid and/or a substance that can release an acid or initiate radicalic reactions is applied to the yarn, (e.g. by means of padding, coating, foaming, printing, etc.). Subsequently the yarn is subjected to further processing for fabric and garment production.

The color changing effect in such pretreated denim fabrics is then generated with a laser treatment.

Fabrics treated according to the foregoing examples are subsequently rinsed with water, washed under acidic conditions (e.g. pH≤5) and/or basic conditions (e.g. pH≥10) at cold and/or warm conditions (e.g. 30-90° C.) and a combination thereof.

These fabrics are subsequently washed with methods known to the skilled person of the art, e.g. chlorine treatment, hydrogen peroxide treatment, potassium peroxide treatment, ozone treatment, enzyme (cellulose, laccase, peroxidase, etc.) treatment, stonewashing, glucose treatment, organo peroxide treatment, softening, tinting (adjusting the colour tone with dyestuffs), etc.

Fabrics treated according to the preceding examples are previously washed with methods known to the skilled person of the art, e.g. chlorine treatment, hydrogen peroxide treatment, potassium peroxide treatment, ozone treatment, enzyme (cellulose, laccase, peroxidase, etc.) treatment, stonewashing, glucose treatment, organo peroxide treatment, scraping, lasering, ice-blasting, carbon dioxide blasting, sand blasting, etc.

Tables 9 to 15 depict compositions in aqueous solutions which are applied to fabrics.

TABLE 9

| # | Nitrate Salt | [%] | Acid Catalyst | [%] | Acid | [%] | Time [h] |
|---|---|---|---|---|---|---|---|
| 1 | $Mg(NO_3)_2 \cdot 6H_2O$ | 51.0 | $MgSO_4$ | 5.7 | methanesulfonic acid | 10.0 | 0.5 |
| 2 | $Mg(NO_3)_2 \cdot 6H_2O$ | 51.0 | $Ce(SO_4)_2$ | 1.0 | methanesulfonic acid | 10.0 | 0.5 |
| 3 | $Mg(NO_3)_2 \cdot 6H_2O$ | 51.0 | $VOSO_4$ | 4.2 | methanesulfonic acid | 10.0 | 0.5 |
| 4 | $Mg(NO_3)_2 \cdot 6H_2O$ | 51.0 | $FeSO_4$ | 1.6 | methanesulfonic acid | 10.0 | 0.5 |
| 5 | $Mg(NO_3)_2 \cdot 6H_2O$ | 51.0 | $Fe_2(SO_4)_3$ | 6.5 | methanesulfonic acid | 10.0 | 0.5 |
| 6 | $Mg(NO_3)_2 \cdot 6H_2O$ | 52.0 | | | citric acid | 30.0 | 4 |
| 7 | $Mg(NO_3)_2 \cdot 6H_2O$ | 34.8 | | | tartaric acid | 40.0 | 2 |
| 8 | $Mg(NO_3)_2 \cdot 6H_2O$ | 55.1 | | | oxalic acid | 5.0 | 0.5 |
| 9 | $Mg(NO_3)_2 \cdot 6H_2O$ | 51.0 | | | methanesulfonic acid | 10.0 | 0.5 |
| 10 | $Mg(NO_3)_2 \cdot 6H_2O$ | 51.0 | | | nitric acid | 6.5 | 0.5 |
| 11 | $Mg(NO_3)_2 \cdot 6H_2O$ | 51.0 | | | methanesulfonic acid | 10.0 | 0.5 |
| 12 | $Mg(NO_3)_2 \cdot 6H_2O$ | 51.0 | | | HCl 25% | 10.0 | 0.5 |
| 13 | $Mg(NO_3)_2 \cdot 6H_2O$ | 51.0 | $ZnCl_2$ | 3.3 | methanesulfonic acid | 10.0 | 0.5 |
| 14 | $Mg(NO_3)_2 \cdot 6H_2O$ | 51.0 | $FeCl_3$ 90% | 9.7 | methanesulfonic acid | 10.0 | 0.5 |
| 15 | $Mg(NO_3)_2 \cdot 6H_2O$ | 51.0 | $CuCl_2$ | 4.1 | methanesulfonic acid | 10.0 | 0.5 |
| 16 | $Mg(NO_3)_2 \cdot 6H_2O$ | 51.0 | $FeCl_2$ | 4.8 | methanesulfonic acid | 10.0 | 0.5 |
| 17 | $Mg(NO_3)_2 \cdot 6H_2O$ | 51.0 | $AlCl_3$ | 3.2 | methanesulfonic acid | 10.0 | 0.5 |
| 18 | $Mg(NO_3)_2 \cdot 6H_2O$ | 40.0 | | | maleic acid | 16.0 | 1 |
| | $LiNO_3$ | 2.0 | | | | | |
| 19 | $Mg(NO_3)_2 \cdot 6H_2O$ | 57.0 | | | $H_2SO_4$ | 5.0 | 0.5 |
| | $LiNO_3$ | 2.9 | | | | | |

TABLE 9-continued

| # | Nitrate Salt | [%] | Acid Catalyst | [%] | Acid | [%] | Time [h] |
|---|---|---|---|---|---|---|---|
| 20 | $Mg(NO_3)_2 \cdot 6H_2O$ | 51.0 | | | HCl 25% | 15.0 | 0.5 |
| | $LiNO_3$ | 2.6 | | | | | |
| 21 | $Mg(NO_3)_2 \cdot 6H_2O$ | 30.0 | | | tartaric acid | 30.0 | 3 |
| | $LiNO_3$ | 1.5 | | | | | |
| 22 | $Mg(NO_3)_2 \cdot 6H_2O$ | 60.0 | | | $H_2SO_4$ 98% | 1.0 | 0.5 |
| | $LiNO_3$ | 3.0 | | | | | |
| 23 | $LiNO_3$ | 27.9 | | | methanesulfonic acid | 10.0 | 0.5 |
| 24 | $Al(NO_3)_3$ | 50.5 | | | methanesulfonic acid | 10.0 | 0.5 |
| 25 | $Ca(NO_3)_2$ | 47.7 | | | methanesulfonic acid | 10.0 | 0.5 |
| 26 | $Fe(NO_3)_3 \cdot 9H_2O$ | 54.0 | | | methanesulfonic acid | 10.0 | 0.5 |
| 27 | $Cu(NO_3)_2$ | 48.0 | | | methanesulfonic acid | 10.0 | 0.5 |
| 28 | $Zn(NO_3)_2$ | 60.0 | | | methanesulfonic acid | 10.0 | 0.5 |
| 29 | $KNO_3$ | 40.0 | | | methanesulfonic acid | 10.0 | 0.5 |
| 30 | $LiNO_3$ | 13.9 | | | methanesulfonic acid | 10.0 | 0.5 |
| 31 | $KNO_3$ | 20.0 | | | methanesulfonic acid | 10.0 | 0.5 |
| 32 | $Fe(NO_3)_3 \cdot 9H_2O$ | 40.0 | | | methanesulfonic acid | 10.0 | 0.5 |
| 33 | $(NH_4)_2Ce(NO_3)_6$ | 36.0 | | | methanesulfonic acid | 10.0 | 0.5 |
| 34 | $Co(NO_3)_2 \cdot 6H_2O$ | 58.0 | | | methanesulfonic acid | 10.0 | 0.5 |
| 35 | $Al(NO_3)_3 \cdot 9H_2O$ | 30.0 | | | citric acid | 25.0 | 4 |
| 36 | $Mg(NO_3)_2 \cdot 6H_2O$ | 63.0 | | | methanesulfonic acid | 10.0 | 0.3 |

TABLE 10

| # | $Mg(NO_3)_2 \cdot 6H_2O$ [%] | +Nitrate Salt [%] | Acid Catalyst [%] | Acid [%] | Additive [%] | Thickener [%] | Temp [° C.] | Time [min] |
|---|---|---|---|---|---|---|---|---|
| 37 | 25 | $Al(NO_3)_3 \cdot 9H_2O$ 5 | | | | xanthan gum 0.3 | 50 | 20 |
| 38 | 25 | $Al(NO_3)_3 \cdot 9H_2O$ 4 | | | | xanthan gum 0.3 | 50 | 20 |
| 39 | 25 | $Al(NO_3)_3 \cdot 9H_2O$ 3 | | | | xanthan gum 0.3 | 50 | 20 |
| 40 | 25 | $Al(NO_3)_3 \cdot 9H_2O$ 2 | | | | xanthan gum 0.3 | 50 | 20 |
| 41 | 25 | $Al(NO_3)_3 \cdot 9H_2O$ 1 | | | | xanthan gum 0.3 | 50 | 20 |
| 42 | 25 | $Al(NO_3)_3 \cdot 9H_2O$ 0.1 | | tartaric acid 1 | | | 60 | 20 |
| 43 | 25 | $Al(NO_3)_3 \cdot 9H_2O$ 45 | | | | | 80 | 20 |
| 44 | | $Al(NO_3)_3 \cdot 9H_2O$ 40 | | | | | 80 | 20 |
| 45 | | $Al(NO_3)_3 \cdot 9H_2O$ 35 | | | | | 80 | 20 |
| 46 | | $Al(NO_3)_3 \cdot 9H_2O$ 30 | | | | | 80 | 20 |
| 47 | | $Al(NO_3)_3 \cdot 9H_2O$ 25 | | | | | 80 | 20 |
| 48 | | $Al(NO_3)_3 \cdot 9H_2O$ 20 | | | | | 80 | 20 |
| 49 | | $Al(NO_3)_3 \cdot 9H_2O$ 18 | | | | | 80 | 20 |
| 50 | 70 | | $CaCl_2$ 2 | | | | 20 | 20 |
| 51 | 70 | | $ZnCl_2$ 2 | | | | 20 | 20 |
| 52 | 70 | | NaCl 2 | | | | 20 | 20 |
| 53 | 70 | | KCl 2 | | | | 20 | 20 |
| 54 | 70 | | LiCl 2 | | | | 20 | 20 |
| 55 | 70 | | $SrCl_2$ 2 | | | | 20 | 20 |
| 56 | 70 | | $MgCl_2$ 2 | | | | 20 | 20 |
| 57 | 70 | | $(NH_4)_2SO_4$ 2 | | | | 20 | 20 |
| 58 | 70 | | $CuSO_4$ 2 | | | | 20 | 20 |
| 59 | 70 | | $Li_2SO_4$ 2 | | | | 20 | 20 |
| 60 | 70 | | $NH_4Al(SO_4)_2$ 2 | | | | 20 | 20 |
| 61 | 70 | | $KAl(SO_4)_2$ 2 | | | | 20 | 20 |
| 62 | 70 | | $FeSO_4$ 2 | | | | 20 | 20 |
| 63 | | | $Ce(SO_4)_2$ 2 | | | | 20 | 20 |
| 64 | 20 | $Al(NO_3)_3 \cdot 9H_2O$ 4 | | | $Zn(NO_3)_2 \cdot 6H_2O$ 0.05 | xanthan gum 0.15 | 60 | 20 |
| 65 | 25 | $Fe(NO_3)_2 \cdot 6H_2O$ 1 | | tartaric acid 4 | | | 80 | 10 |
| 66 | 30 | $Fe(NO_3)_2 \cdot 6H_2O$ 0.01 | | tartaric acid 1 | | | 80 | 20 |
| 67 | | $LiNO_3$ 30 | | | | | 80 | 20 |
| 68 | 35 | | $CaCl_2$ 2 | citric acid 10 | | | 60 | 20 |
| 69 | 35 | | $ZnCl_2$ 2 | citric acid 10 | | | 60 | 20 |
| 70 | 35 | | NaCl 2 | citric acid 10 | | | 60 | 20 |
| 71 | 35 | | KCl 2 | citric acid 10 | | | 60 | 20 |
| 72 | 35 | | LiCl 2 | citric acid 10 | | | 60 | 20 |
| 73 | 35 | | $SrCl_2$ 2 | citric acid 10 | | | 60 | 20 |
| 74 | 35 | | $MgCl_2$ 2 | citric acid 10 | | | 60 | 20 |
| 75 | 35 | | $(NH_4)_2SO_4$ 2 | citric acid 10 | | | 60 | 20 |
| 76 | 35 | | $CuSO_4$ 2 | citric acid 10 | | | 60 | 20 |
| 77 | 35 | | $Li_2SO_4$ 2 | citric acid 10 | | | 60 | 20 |
| 78 | 35 | | $NH_4Al(SO_4)_2$ 2 | citric acid 10 | | | 60 | 20 |
| 79 | 35 | | $KAl(SO_4)_2$ 2 | citric acid 10 | | | 60 | 20 |
| 80 | 35 | | $FeSO_4$ 2 | citric acid 10 | | | 60 | 20 |
| 81 | 35 | | $Ce(SO_4)_2$ 2 | citric acid 10 | | | 60 | 20 |
| 82 | 35 | | $CaCl_2$ 2 | tartaric acid 4 | | | 60 | 20 |
| 83 | 35 | | $ZnCl_2$ 2 | tartaric acid 4 | | | 60 | 20 |
| 84 | 35 | | NaCl 2 | tartaric acid 4 | | | 60 | 20 |
| 85 | 35 | | KCl 2 | tartaric acid 4 | | | 60 | 20 |

TABLE 10-continued

| # | $Mg(NO_3)_2 \cdot 6H_2O$ [%] | +Nitrate Salt [%] | Acid Catalyst [%] | Acid [%] | Additive [%] | Thickener [%] | Temp [° C.] | Time [min] |
|---|---|---|---|---|---|---|---|---|
| 86 | 35 | | LiCl 2 | tartaric acid 4 | | | 60 | 20 |
| 87 | 35 | | $SrCl_2$ 2 | tartaric acid 4 | | | 60 | 20 |
| 88 | 35 | | $MgCl_2$ 2 | tartaric acid 4 | | | 60 | 20 |
| 89 | 35 | | $(NH_4)_2SO_4$ 2 | tartaric acid 4 | | | 60 | 20 |
| 90 | 35 | | $CuSO_4$ 2 | tartaric acid 4 | | | 60 | 20 |
| 91 | 35 | | $Li_2SO_4$ 2 | tartaric acid 4 | | | 60 | 20 |
| 92 | 35 | | $NH_4Al(SO_4)_2$ 2 | tartaric acid 4 | | | 60 | 20 |
| 93 | 35 | | $KAl(SO_4)_2$ 2 | tartaric acid 4 | | | 60 | 20 |
| 94 | 35 | | $FeSO_4$ 2 | tartaric acid 4 | | | 60 | 20 |
| 95 | 35 | | $Ce(SO_4)$ 2 | tartaric acid 4 | | | 60 | 20 |
| 96 | 25 | | | tartaric acid 5 | $Zn(NO_3)_2 \cdot 6H_2O$ 0.09 | | 60 | 20 |

TABLE 11

| # | $Mg(NO_3)_2 \cdot 6H_2O$ [%] | +Nitrate Salt | [%] | Acid | [%] | Addition | [%] | Thickener | [%] | Temp [° C.] | Time [min] |
|---|---|---|---|---|---|---|---|---|---|---|---|
| 97 | 26.6 | $Zn(NO_3)_2 \cdot 6H_2O$ | 0.05 | tartaric acid | 2 | | | | | 60 | 20 |
| 98 | 26.6 | $Zn(NO_3)_2 \cdot 6H_2O$ | 0.05 | malonic acid | 2 | | | | | 60 | 20 |
| 99 | 26.6 | $Zn(NO_3)_2 \cdot 6H_2O$ | 0.05 | citric acid | 2 | | | | | 60 | 20 |
| 100 | 26.6 | $Zn(NO_3)_2 \cdot 6H_2O$ | 0.05 | maleic acid | 2 | | | | | 60 | 20 |
| 101 | 26.6 | $Zn(NO_3)_2 \cdot 6H_2O$ | 0.05 | methanesulfonic acid | 5 | | | | | 60 | 20 |
| 102 | 26.6 | $Zn(NO_3)_2 \cdot 6H_2O$ | 0.05 | methanesulfonic acid | 10 | | | | | 60 | 20 |
| 103 | 26.6 | $Zn(NO_3)_2 \cdot 6H_2O$ | 0.05 | tartaric acid | 2 | DMSO | 1 | | | 60 | 20 |
| 104 | 26.6 | $Zn(NO_3)_2 \cdot 6H_2O$ | 0.05 | tartaric acid | 2 | $LiNO_3$ | 1 | | | 60 | 20 |
| 105 | 26.6 | $Zn(NO_3)_2 \cdot 6H_2O$ | 0.05 | tartaric acid | 2 | triethanolamine | 5 | | | 60 | 20 |

TABLE 12

| # | $Mg(NO_3)_2 \cdot 6H_2O$ [%] | Acid Catalyst | [%] | Acid | [%] | Temp [° C.] | Time [min] |
|---|---|---|---|---|---|---|---|
| 106 | 35 | $KAl(SO_4)_2 \cdot 12H_2O$<br>LiCl | 5<br>2.5 | tartaric acid | 2 | 60 | 20 |
| 107 | 35 | $KAl(SO_4)_2 \cdot 12H_2O$<br>LiCl | 5<br>1 | tartaric acid | 2 | 60 | 20 |
| 108 | 35 | $KAl(SO_4)_2 \cdot 12H_2O$<br>LiCl | 5<br>0.5 | tartaric acid | 2 | 60 | 20 |
| 109 | 35 | $KAl(SO_4)_2 \cdot 12H_2O$<br>LiCl | 5<br>0.1 | tartaric acid | 2 | 60 | 20 |
| 110 | 35 | $KAl(SO_4)_2 \cdot 12H_2O$ | 5 | malonic acid | 2 | 60 | 20 |
| 111 | 35 | $KAl(SO_4)_2 \cdot 12H_2O$ | 5 | citric acid | 2 | 60 | 20 |
| 112 | 35 | $KAl(SO_4)_2 \cdot 12H_2O$ | 5 | maleic acid | 2 | 60 | 20 |
| 113 | 35 | $KAl(SO_4)_2 \cdot 12H_2O$ | 5 | lactic acid | 2 | 60 | 20 |
| 114 | 35 | $KAl(SO_4)_2 \cdot 12H_2O$ | 5 | oxalic acid | 2 | 60 | 20 |

TABLE 13

| # | $Mg(NO_3)_2 \cdot 6H_2O$ [%] | Acid Catalyst | [%] | Acid | [%] | Additive | [%] | Temp [° C.] | Time [min] |
|---|---|---|---|---|---|---|---|---|---|
| 115 | 35 | $KAl(SO_4)_2 \cdot 12H_2O$ | 5 | acetic acid | 2 | | | 60 | 20 |
| 116 | 35 | $KAl(SO_4)_2 \cdot 12H_2O$ | 5 | phosphoric acid | 1 | | | 60 | 20 |
| 117 | 70 | $KAl(SO_4)_2 \cdot 12H_2O$ | 5 | hydrochloric acid | 3.6 | | | 60 | 20 |
| 118 | 35 | $KAl(SO_4)_2 \cdot 12H_2O$ | 5 | sulphuric acid | 4.5 | | | 60 | 20 |
| 119 | 35 | $KAl(SO_4)_2 \cdot 12H_2O$ | 5 | salpetric acid | 1.5 | | | 60 | 20 |
| 120 | 35 | $KAl(SO_4)_2 \cdot 12H_2O$ | 5 | tartaric acid | 2 | Dispersoko ICP 100 CO | 0.01 | 60 | 20 |
| 121 | 35 | $KAl(SO_4)_2 \cdot 12H_2O$ | 5 | tartaric acid | 2 | Dispersoko ICP 100 PL | 0.01 | 60 | 20 |
| 122 | 35 | $KAl(SO_4)_2 \cdot 12H_2O$ | 5 | tartaric acid | 2 | polysorbate 20 | 0.1 | 60 | 20 |
| 123 | 35 | $KAl(SO_4)_2 \cdot 12H_2O$ | 5 | tartaric acid | 2 | Nofome AF | 0.1 | 60 | 20 |

TABLE 14

| # | $Mg(NO_3)_2 \cdot 6H_2O$ [%] | Nitrate Salt | [%] | Acid Catalyst | [%] | Acid | [%] | Additive | [%] | Temp [° C.] | Time [min] |
|---|---|---|---|---|---|---|---|---|---|---|---|
| 124 | 35 | | | $KAl(SO_4)_2 \cdot 12H_2O$ | 5 | tartaric acid | 2 | Setamol Disperse WS | 0.1 | 60 | 20 |
| 125 | 26.6 | $Zn(NO_3)_2 \cdot 6H_2O$ | 0.05 | | | tartaric acid | 2 | Methyl red | 0.01 | 60 | 20 |
| 126 | 26.6 | $Zn(NO_3)_2 \cdot 6H_2O$ | 0.05 | | | tartaric acid | 2 | Chromene Red | 0.005 | 60 | 20 |
| 127 | 26.6 | $Zn(NO_3)_2 \cdot 6H_2O$ | 0.05 | | | tartaric acid | 2 | Chromene Red | 0.01 | 60 | 20 |
| 128 | 26.6 | $Zn(NO_3)_2 \cdot 6H_2O$ | 0.05 | | | tartaric acid | 2 | Chromene Red | 0.015 | 60 | 20 |
| 129 | 26.6 | $Zn(NO_3)_2 \cdot 6H_2O$ | 0.05 | | | tartaric acid | 2 | Chromene Red | 0.02 | 60 | 20 |
| 130 | 26.6 | $Zn(NO_3)_2 \cdot 6H_2O$ | 0.05 | | | tartaric acid | 2 | Chromene Red | 0.025 | 60 | 20 |
| 131 | 35 | | | $KAl(SO_4)_2 \cdot 12H_2O$ | 5 | tartaric acid | 2 | Methyl red | 0.01 | 60 | 20 |
| 132 | 35 | | | $KAl(SO_4)_2 \cdot 12H_2O$ | 5 | tartaric acid | 2 | Chromene Red | 0.005 | 60 | 20 |
| 133 | 35 | | | $KAl(SO_4)_2 \cdot 12H_2O$ | 5 | tartaric acid | 2 | Chromene Red | 0.01 | 60 | 20 |

TABLE 15

| # | $Mg(NO_3)_2 \cdot 6H_2O$ [%] | Acid Catalyst/ Nitrate Salt | [%] | Acid | [%] | Additive | [%] | Thickener | [%] | Temp [° C.] | Time [min] |
|---|---|---|---|---|---|---|---|---|---|---|---|
| 134 | 35 | $KAl(SO_4)_2 \cdot 12H_2O$ | 5 | tartaric acid | 2 | Chromene Red | 0.015 | | | 60 | 20 |
| 135 | 35 | $KAl(SO_4)_2 \cdot 12H_2O$ | 5 | tartaric acid | 2 | Chromene Red | 0.02 | | | 60 | 20 |
| 136 | 35 | $KAl(SO_4)_2 \cdot 12H_2O$ | 5 | tartaric acid | 2 | Chromene Red | 0.025 | | | 60 | 20 |
| 137 | 35 | | | | | monosodium phosphate | 2 | | | 60 | 20 |
| 138 | 35 | | | | | monosodium phosphate | 5 | | | 60 | 20 |
| 139 | 35 | | | | | monopotassium phosphate | 2 | | | 60 | 20 |
| 140 | 35 | | | | | monopotassium phosphate | 5 | | | 60 | 20 |
| 141 | 35 | | | | | | | | | 60 | 20 |
| 142 | 35 | | | | | disodium pyrophosphate | 5 | | | 60 | 20 |
| 143 | 25 | | | | | disodium pyrophosphate | 5 | | | 60 | 20 |
| 144 | 20 | | | | | disodium pyrophosphate | 5 | | | 60 | 20 |
| 145 | 15 | | | | | disodium pyrophosphate | 5 | | | 60 | 20 |
| 146 | 35 | | | | | disodium pyrophosphate | 5 | | | 45 | 20 |
| 147 | 20 | | | | | disodium pyrophosphate | 5 | | | 45 | 20 |
| 148 | 35 | | | tartaric acid | 1 | Tetranatrium-diphosphate | 1.5 | | | 60 | 20 |
| 149 | 26.6 | $Zn(NO_3)_2 \cdot 6H_2O$ | 0.05 | tartaric acid | 2 | Trilon M | 0.01 | | | 60 | 20 |
| 150 | 26.6 | $Zn(NO_3)_2 \cdot 6H_2O$ | 0.05 | tartaric acid | 2 | Dissolvine GL 38 | 0.01 | | | 60 | 20 |

The invention claimed is:

1. A method for changing the color of a dyed denim textile material to obtain a vintage and/or worn appearance, comprising the steps of:

(a) contacting the denim textile material with a solution of $Mg(NO_3)_2$, (b) activating the $Mg(NO_3)_2$ by the addition of a citrate catalyst, and (c) maintaining step (b) until the desired color change is achieved, wherein steps (a)-(c) are conducted at a temperature below 90° C., and wherein a $\Delta L$ value between the denim textile material before step (a) and after step (c) is greater than 2, wherein L refers to lightness as defined by CIE 1976 Lab color space.

2. The method according to claim 1, wherein the $Mg(NO_3)_2$ and citrate catalyst are in an aqueous solution comprising about 1-75 vol % $Mg(NO_3)_2$ and 0.5-50 vol % citrate catalyst and wherein the aqueous solution optionally further comprises a peroxide.

3. The method according to claim 1, wherein the treatment is carried out at a temperature of about 10 to below 90° C., or at a temperature of about 10 to 60° C., or at a temperature of about 10 to 50° C., or at room temperature.

4. The method according to claim 1, wherein the dyed denim textile material is dyed with a dye selected from the group consisting of sulphur dye, VAT dye, natural dyes and a combination of any of the foregoing.

5. The method according to claim 1, wherein the pH of the solution is higher than 2.

6. The method according to claim 1, further comprising the step of applying a laser beam to the denim textile material to generate $NO_x$ compounds.

7. The method according to claim 6, wherein the laser beam consists of infrared light or light having a wavelength of 10.6 μm.

* * * * *